US010981707B2

(12) United States Patent
Peng et al.

(10) Patent No.: US 10,981,707 B2
(45) **Date of Patent: *Apr. 20, 2021**

(54) DRINK CUP LID

(71) Applicant: Berry Plastics Corporation, Evansville, IN (US)

(72) Inventors: Yucheng Peng, Evansville, IN (US); Jonathan Eickhoff, Evansville, IN (US); Ryan Dewig, Evansville, IN (US); Jeffrey A. Mann, Evansville, IN (US); Debra R. Wilson, Houston, TX (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/736,849

(22) Filed: Jan. 8, 2020

(65) Prior Publication Data

US 2020/0140160 A1 May 7, 2020

Related U.S. Application Data

(63) Continuation of application No. 15/946,023, filed on Apr. 5, 2018, now Pat. No. 10,577,159.

(60) Provisional application No. 62/482,959, filed on Apr. 7, 2017.

(51) Int. Cl.

| | |
|---|---|
| ***B65D 51/24*** | (2006.01) |
| ***B65D 43/02*** | (2006.01) |
| ***A47G 19/22*** | (2006.01) |

(52) U.S. Cl.

CPC ..... *B65D 51/245* (2013.01); *A47G 19/2272* (2013.01); *B65D 43/0208* (2013.01); *B65D 2231/022* (2013.01); *B65D 2543/00027* (2013.01); *B65D 2543/00092* (2013.01); *B65D 2543/00296* (2013.01); *B65D 2543/00342* (2013.01); *B65D 2543/00509* (2013.01); *B65D 2543/00518* (2013.01); *B65D 2543/00537* (2013.01); *B65D 2543/00731* (2013.01); *B65D 2543/00814* (2013.01)

(58) Field of Classification Search

CPC ..... B65D 51/245; B65D 43/0208; B65D 43/00092; B65D 43/00027; A47G 19/2272

USPC ..... 220/713

See application file for complete search history.

(56) References Cited

U.S. PATENT DOCUMENTS

| | | | |
|---|---|---|---|
| D7,248 | S | 3/1874 | elstrand |
| 3,027,596 | A | 4/1962 | Knowles |
| 3,392,468 | A | 7/1968 | Wolf |
| 4,061,706 | A | 12/1977 | Duffield |
| 4,413,964 | A | 11/1983 | Winstead |
| 4,722,820 | A | 2/1988 | Flecknoe-Brown |
| 4,994,229 | A | 2/1991 | Flecknoe-Brown |
| D317,262 | S | 6/1991 | Bluff |
| 5,106,567 | A | 4/1992 | Demerest |

(Continued)

OTHER PUBLICATIONS

Third Party Submission Under 37 CFR 1.290 in U.S. Appl. No. 16/057,122, dated Apr. 16, 2020, 49 pages.

(Continued)

*Primary Examiner* — King M Chu

(74) *Attorney, Agent, or Firm* — Barnes & Thornburg LLP

(57) ABSTRACT

A container includes a cup and a lid. The lid is adapted to mate with a brim included in the cup to close a top aperture opening into an interior liquid-storage region formed in the cup.

20 Claims, 8 Drawing Sheets

(56) References Cited

U.S. PATENT DOCUMENTS

| | | | | |
|---|---|---|---|---|
| 5,614,228 | A | 3/1997 | Demerest | |
| D384,862 | S | 10/1997 | Hayes | |
| 5,783,229 | A | 7/1998 | Manlove | |
| 5,795,535 | A | 8/1998 | Giovannone | |
| D408,223 | S | 4/1999 | Henry | |
| D428,355 | S | 7/2000 | Kavalek | |
| D432,868 | S | 10/2000 | Tan | |
| D437,671 | S | 2/2001 | Fajerstein | |
| 6,561,122 | B1 | 5/2003 | Kurja | |
| D492,901 | S | 7/2004 | Woods | |
| D529,391 | S | 10/2006 | Glass | |
| D543,787 | S | 6/2007 | Wasserman | |
| 7,232,302 | B2 | 6/2007 | Marzona | |
| D559,105 | S | 1/2008 | D'Amato | |
| D578,829 | S | 10/2008 | Freeman | |
| D588,002 | S | 3/2009 | D'Amato | |
| D591,476 | S | 5/2009 | Colman | |
| D613,199 | S | 4/2010 | Schneider | |
| 8,038,432 | B2 | 10/2011 | Mazzarolo | |
| 8,211,355 | B2 | 7/2012 | Otto | |
| 8,282,382 | B2 | 10/2012 | Mazzarolo | |
| D693,181 | S | 11/2013 | Chase | |
| 8,628,319 | B2 | 1/2014 | Mazzarolo | |
| 8,662,880 | B2 | 3/2014 | Fowler | |
| D744,288 | S | 12/2015 | Rosen | |
| 9,814,334 | B2 | 11/2017 | Eickhoff | |
| 9,815,239 | B2 | 11/2017 | Borse | |
| D838,591 | S | 1/2019 | Lee | |
| D845,128 | S | 4/2019 | Eickhoff | |
| 10,286,593 | B2 | 5/2019 | Topolkaraev | |
| D850,260 | S | 6/2019 | Eickhoff | |
| D867,873 | S | 11/2019 | Troudt | |
| D885,911 | S | 6/2020 | Silva | |
| D885,912 | S | 6/2020 | Silva | |
| 2006/0097516 | A1* | 5/2006 | Kozlowski | A61J 7/04 283/117 |
| 2009/0313956 | A1 | 12/2009 | Martinez Sampedro | |
| 2010/0255137 | A1 | 10/2010 | Mazzarolo | |
| 2011/0062173 | A1 | 3/2011 | Trotter | |
| 2011/0124817 | A1 | 5/2011 | Dias | |
| 2011/0297573 | A1 | 12/2011 | Chen | |
| 2012/0261417 | A1* | 10/2012 | Tabor et al. | A47G 19/2272 220/254.1 |
| 2014/0072674 | A1 | 3/2014 | Holinda, Jr. | |
| 2015/0094406 | A1* | 4/2015 | Miley | C07C 233/81 524/89 |
| 2015/0337059 | A1* | 11/2015 | St. Jean | B01J 19/2455 428/36.9 |
| 2015/0344647 | A1 | 12/2015 | Maeda | |
| 2016/0137364 | A1 | 5/2016 | Pirrella | |
| 2018/0022012 | A1 | 1/2018 | Rapparini | |
| 2018/0050826 | A1 | 2/2018 | Hartman | |
| 2018/0127161 | A1 | 5/2018 | Smith | |
| 2018/0133919 | A1 | 5/2018 | Waterman | |
| 2018/0290798 | A1 | 10/2018 | Peng | |
| 2019/0039328 | A1 | 2/2019 | Eickhoff | |

OTHER PUBLICATIONS

Solo 668NS: Site Visited [Apr. 30, 2020]. Available from Internet URL: https://www.dartcontainer.com/products/foodservice-catalog/accessories/lids/solo-pet-plastic-flat-cold-cup-lids/668ns/ 1/2.

Single Use Spill REsistant Flat Lid_Berry Global: Site Visited [Apr. 30, 2020]. Available from Internet URL: https://catalog.berry-global.com/products/lid/liddrink/dlt308srcp.

Thermoform Strawless Lid with Straw Slot_Berry Global: Site Visited [Apr. 30, 2020]. Available from Internet URL: https://catalog.berryglobal .com/products/lid/liddrink/dlt402ssl p.

International Search Report and Writen Opinion dated Apr. 29, 2020, 11 pages.

Office Action dated Mar. 19, 2020, for U.S. Appl. No. 15/172,650, (pp. 1-11).

International (PCT) Search Report and Written Opinion for PCT/US20/46469 dated Nov. 30, 2020, 9 pages.

International (PCT) Search Report and Written Opinion for PCT/2020/016769 dated May 27, 2020, 12 pages.

Chartier Octagonal Wall Modern and Contemporary Accent Mirror: Site Visited [Sep. 14, 2020. Available from Internet URL: https://www.wayfair.com/decor-pillows/pdp/eichholtz-chartier-octagonal-wall-modern-and-contemporary-accent-mirror-eitz2666.html.

Nathan Wall Mounted Mirror: Announced Jul. 2, 2020 [online]. Site Visited [Sep. 14, 2020], Available from Internet URL: https://www.wayfair.com/decor-pillows/pdp/house-of-hampton-nathan-wall-mounted-mirror-hmpt5079.html.

Office Action dated Aug. 20, 2020 for U.S. Appl. No. 16/057,122, (pp. 1-20).

Polymer Properties of Omnexus—Transparency (https://web.archive.Org/web/20170406012756/https://omnexus.specialchem.com/ polymer-properties/properties/transparency, available in public at least on or after Apr. 6, 2017) (Year: 2017).

Polymer Properties of Omnexus—Haze (https://web.archive.Org/web/20170519201652/https://omnexus.specialchem.com/ polymer-properties/properties/haze, available in public at least on or after May 19, 2017) (Year: 2017).

Impact Plastics Blog (http://blog.impactplastics-ct.com/blog/basic-guide-to-the-three-main-grades-of-polypropylene-resin, available in public from the date May 16, 2017) (Year: 2017).

Canadian Filing of Prior Art Under Section 34.1(1) of the Canadian Patent Act by Third Party, Aug. 7, 2020, 20 pages.

Office Action dated Dec. 30, 2020 for U.S. Appl. No. 15/172,650, (pp. 1-24).

European Search Report for European App. No. 18780978.5 dated Jan. 28, 2021, 8 pages.

* cited by examiner

DRINK CUP LID

PRIORITY CLAIM

This application is a continuation of U.S. Non-Provisional patent application Ser. No. 15/946,023, filed Apr. 5, 2018, which claims priority under 35 U.S.C. § 119(e) to U.S. Provisional Application Ser. No. 62/482,959, filed Apr. 7, 2017, both of which are expressly incorporated by reference herein.

BACKGROUND

The present disclosure relates to lids, and particularly to lids for drink cups. More particularly, the present disclosure relates to a cup lid that includes a rim that mates with a brim included in a drink cup.

SUMMARY

According to the present disclosure, a container includes a cup and a lid. The lid is adapted to mate with a brim included in a cup to close a top aperture opening into an interior liquid-storage region formed in the cup.

In illustrative embodiments, a lid for a cup is transparent to allow a consumer to view the contents of the cup through the drink cup lid. In illustrative embodiments, the lid includes a ring-shaped brim mount, a central closure, and at least one deformable product-identification dome coupled to the central closure. The ring-shaped brim mount is adapted to mate the lid with the brim of the cup. The central closure blocks access into the interior-storage region formed in the cup. The deformable product-identification dome is configured to selectively deform to indicate visually a content of the cup such as a selected beverage flavor.

In illustrative embodiments, the product-identification dome is configured to move from an undeformed arrangement to a deformed arrangement to indicate visually a selected content of the cup in response to a downward deformation force. In the undeformed arrangement, the product-identification dome is transparent. In the deformed arrangement, the product-identification dome is at least partially opaque.

In illustrative embodiments, the illustrative product-identification dome includes a plurality of panels and a dome cap. The panels are appended to the central closure and extend upwardly away from central closure in a circular pattern. The dome cap is located in spaced apart relation to the central closure and extends between and interconnects the panels.

In illustrative embodiments, adjacent panels are coupled to one another and coupled to the dome cap at stress concentrator joints. The stress concentrator joints focus stresses in the product-identification dome in response to deformation of the dome to cause the transparency of the product-identification dome to change when moving from the undeformed arrangement to the deformed arrangement.

In illustrative embodiments, the drink cup lid is formed from a sheet of non-aromatic material comprising polypropylene. In illustrative embodiments, the sheet of material comprises about 35% by weight polypropylene base resin and about 55% by weight polypropylene secondary resin. In illustrative embodiments, the base resin is a homopolymer. In illustrative embodiments, the secondary resin is a copolymer. In some embodiments, the sheet of material comprises about 10% of a tertiary resin.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
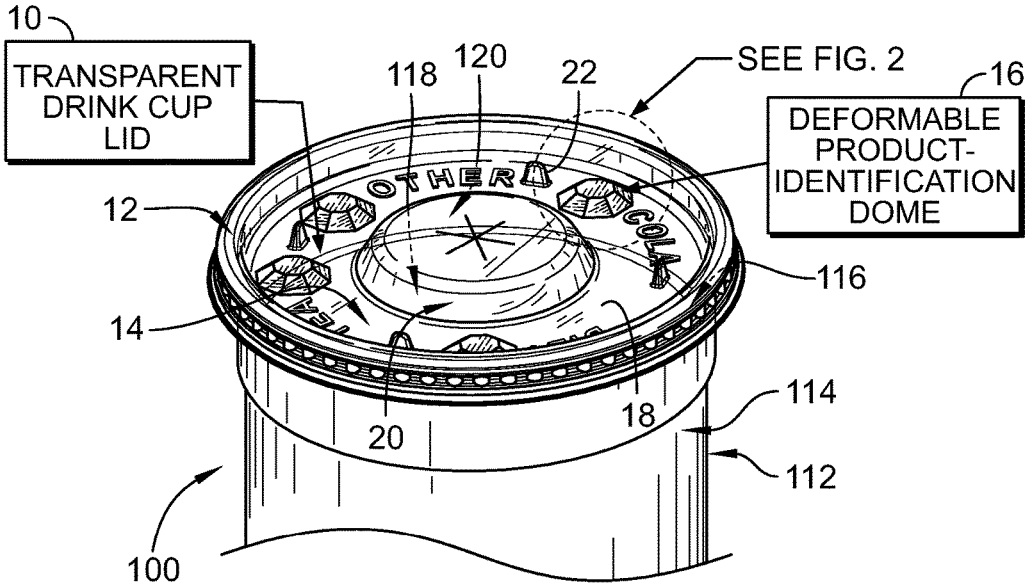
FIG. 1 is a perspective and diagrammatic view of a first embodiment of a polypropylene drink cup lid in accordance with the present disclosure showing that the polypropylene drink cup lid includes a brim mount mated with a brim of a cup, a central closure coupled to the brim mount to close a top aperture opening into an interior liquid-storage region formed in the cup, and a plurality of deformable product-identification domes, the central closure is transparent to allow a consumer to view the contents of the interior liquid-storage region of the cup through the drink cup lid, and each product-identification dome is configured to move from an un-deformed arrangement in which the product-identification dome is transparent, as suggested in FIG. 2, to a deformed arrangement in which the product-identification dome is at least partially opaque to indicate visually a selected content of the cup, such as a selected beverage flavor, in response to a downward deformation force as suggested in FIG. 3.

A first embodiment of a drink cup lid 10 in accordance with the present disclosure having a first embodiment of a deformable product-identification dome 16 is shown in FIGS. 1-8. Other embodiments of a drink cup lid 210, 310, 410, 510, 610, 710, 810, 910, 1010 in accordance with the present disclosure having other embodiments of a deformable product-identification dome 216, 316, 416, 516, 616, 716, 816, 916, 1016 are shown in FIGS. 9-18. Drink cup lids 10, 210, 310, 410, 510, 610, 710, 810, 910, 1010 are comprised from a polypropylene material and are substantially transparent until one of the product-identification domes is moved to a deformed arrangement which, in some examples, causes the product-identification dome to be partially opaque and communicate visually that a beverage has been selected. In some embodiments, drink cup lids 10, 210, 310, 410, 510, 610, 710, 810, 910, 1010 are made from non-aromatic polymeric materials made from a formulation.

Drink cup lid 10 is configured to mount onto a cup 112 to provide a container 100 as shown in FIG. 1. Container 100 is configured to store food products such as, for example, a liquid beverage. Cup 112 includes a floor (not shown) and a sidewall 114 that cooperate to define an interior liquid-storage region 118 and a brim 116 that defines a top aperture 120 that opens into interior liquid-storage region 118. Drink cup lid 10 mounts with brim 116 to block contents of interior liquid-storage region 118 from escaping cup 112 through top aperture 120. In illustrative embodiments, drink cup lid 10 is transparent to allow a consumer to view contents of interior liquid-storage region 118 of cup 112 through drink cup lid 10.

Drink cup lid 10 includes a ring-shaped brim mount 12, a central closure 14, and a plurality of deformable product-identification domes 16 as shown in FIG. 1. Brim mount 12 is configured to mount with brim 116 included in cup 112. Central closure 14 is appended to brim mount 12 and closes top aperture 120 and block access into interior liquid-storage region 118 of cup 112. Product-identification domes 16 append from central closure 14 and are configured to move from an un-deformed arrangement, shown in FIG. 2, to a deformed arrangement, shown in FIG. 3, to indicate visually a selected flavor of a liquid beverage stored in interior liquid-storage region 118 of cup 112.

Product-identification domes 16 indicate to a consumer that a liquid beverage contained in cup 112 should have a flavor corresponding to indicia 30 adjacent a deformed product-identification dome 16. Product-identification domes 16 are configured to change in transparency in response to being deformed into the deformed arrangement to contrast with the transparent central closure 14 and other un-deformed product-identification domes 16 and indicate the selected beverage flavor as suggested in FIGS. 2 and 3. In the un-deformed arrangement, product-identification domes 16 are transparent as suggested in FIG. 2. Portions of product-identification domes 16 have a low transparency and/or are partially opaque when product-identification domes 16 are in the deformed arrangement as suggested in FIG. 3.

Figure 2:
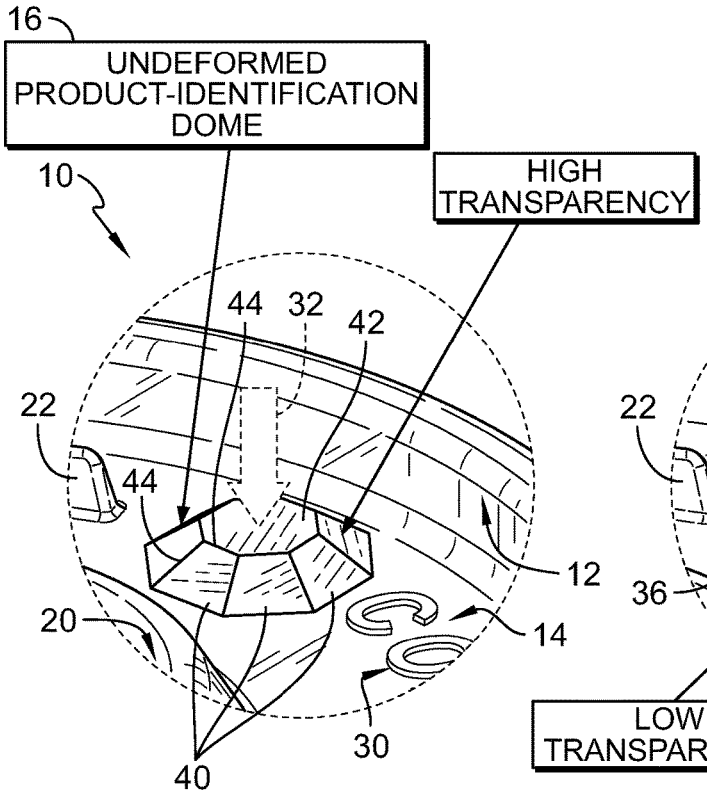
FIG. 2 is an enlarged view of FIG. 1 showing one of the deformable product-identification domes in an initial un-deformed arrangement in which the product-identification dome extends upwardly away from the cup and has high transparency to indicate visually that the product-identification dome is not selected, the product-identification dome having a plurality of panels that form stress concentrators configured to increase the opacity of the product-identification dome in response to the product-identification dome being deformed, and suggesting that the downward deformation force may be applied to the product-identification dome to move the product-identification dome to the deformed arrangement shown in FIG. 3.

In illustrative embodiments, each product-identification dome 16 includes a plurality of panels 40 and a dome cap 42 as shown in FIG. 2. Panels 40 are appended to central closure 14 and arranged to extend upwardly away from central closure 14 in a circular pattern. Dome cap 42 is located in spaced apart relation to central closure 14 and extends between and interconnects panels 40. Illustratively, dome cap 42 is octagon shaped.

Figure 3:
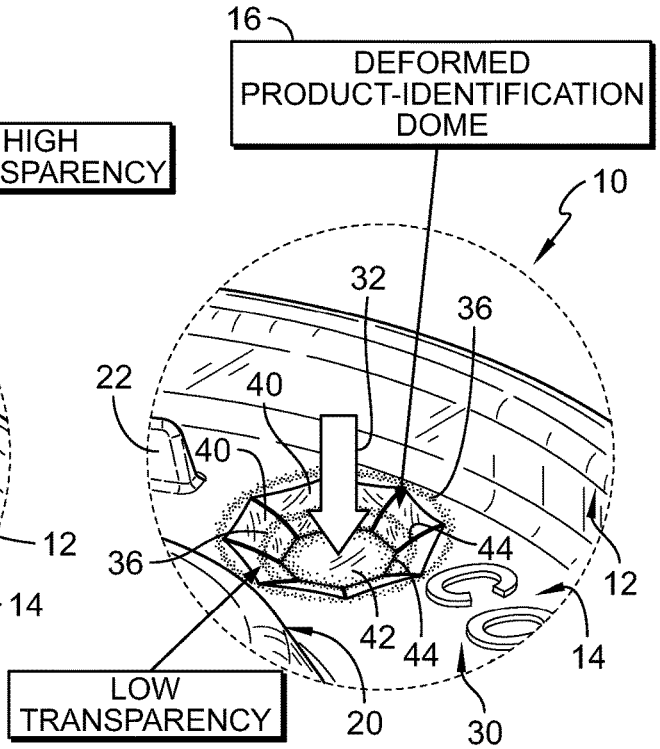
FIG. 3 is a view similar to FIG. 2 after the downward deformation force has been applied to the deformable product-identification dome to cause the product-identification dome to assume the deformed arrangement having high opacity due, in part, to the stress concentrators formed in the product-identification dome, and suggesting that the high opacity of the deformed product-identification dome contrasts with the remaining transparent portions of the drink cup lid to indicate visually the selected contents of the cup.

Adjacent panels 40 are coupled to one another and coupled to dome cap 42 at stress concentrator joints 44 as shown in FIGS. 2 and 3. Stress concentrator joints 44 focus stresses in product-identification domes 16 in response to deformation of domes 16 to cause the transparency of product-identification domes 16 to change when moving from the un-deformed arrangement to the deformed arrangement. In some embodiments, product-identification domes 16 without stress concentrator joints 44 do not change in transparency in the deformed arrangement. In other embodiments, other stress concentrator features are used to cause a transparency of product-identification domes 16 to change in the deformed arrangement.

Drink cup lid 10 includes ring-shaped brim mount 12, central closure 14, and deformable product-identification domes 16 as shown in FIG. 1. Brim mount 12 is configured to mount lid 10 with brim 116 included in cup 112. Central closure 14 is appended to brim mount 12 and closes top aperture 120 and block access into interior liquid-storage region 118 of cup 112. Product-identification domes 16 append from central closure 14 and are configured to move from the un-deformed arrangement, shown in FIG. 2, to the deformed arrangement, shown in FIG. 3, in response to the downward deformation force 32 to indicate visually a selected flavor of a liquid beverage stored in interior liquid-storage region 118 of cup 112.

Brim mount 12 has a round shape with a center point located on a central axis of drink cup lid 10 as suggested in FIGS. 1 and 4-6. In illustrative embodiments, brim mount 12 is transparent.

Figure 4:
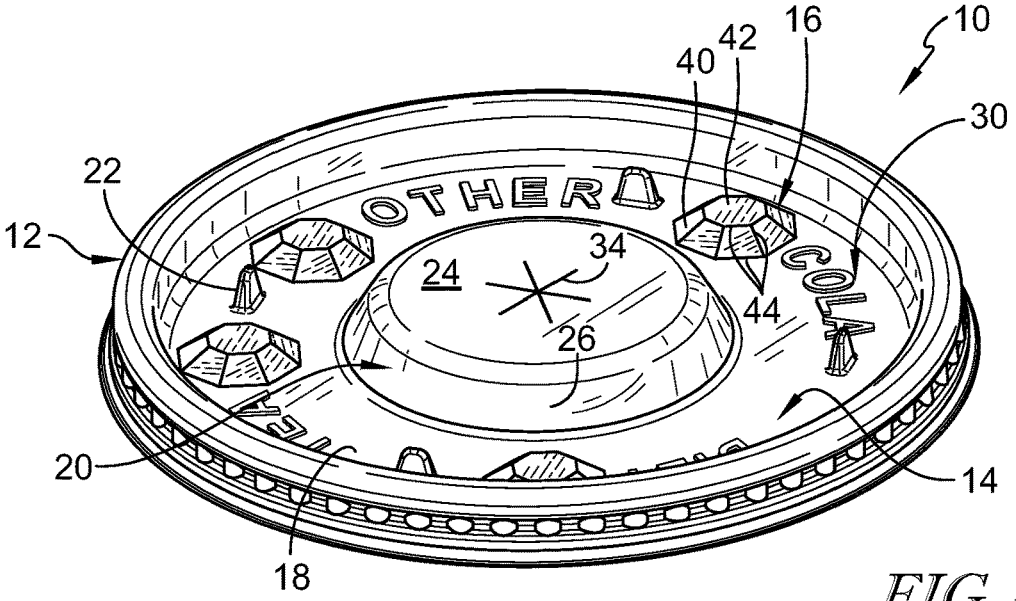
FIG. 4 is a perspective view of the drink cup lid of FIG. 1 showing that the lid includes the central closure, the brim mount arranged around the central closure, and the plurality of deformable product-identification domes and further showing that the central closure is transparent and includes a liquid-retainer floor and an elevated basin arranged to extend upwardly away from the floor.
Figure 5:
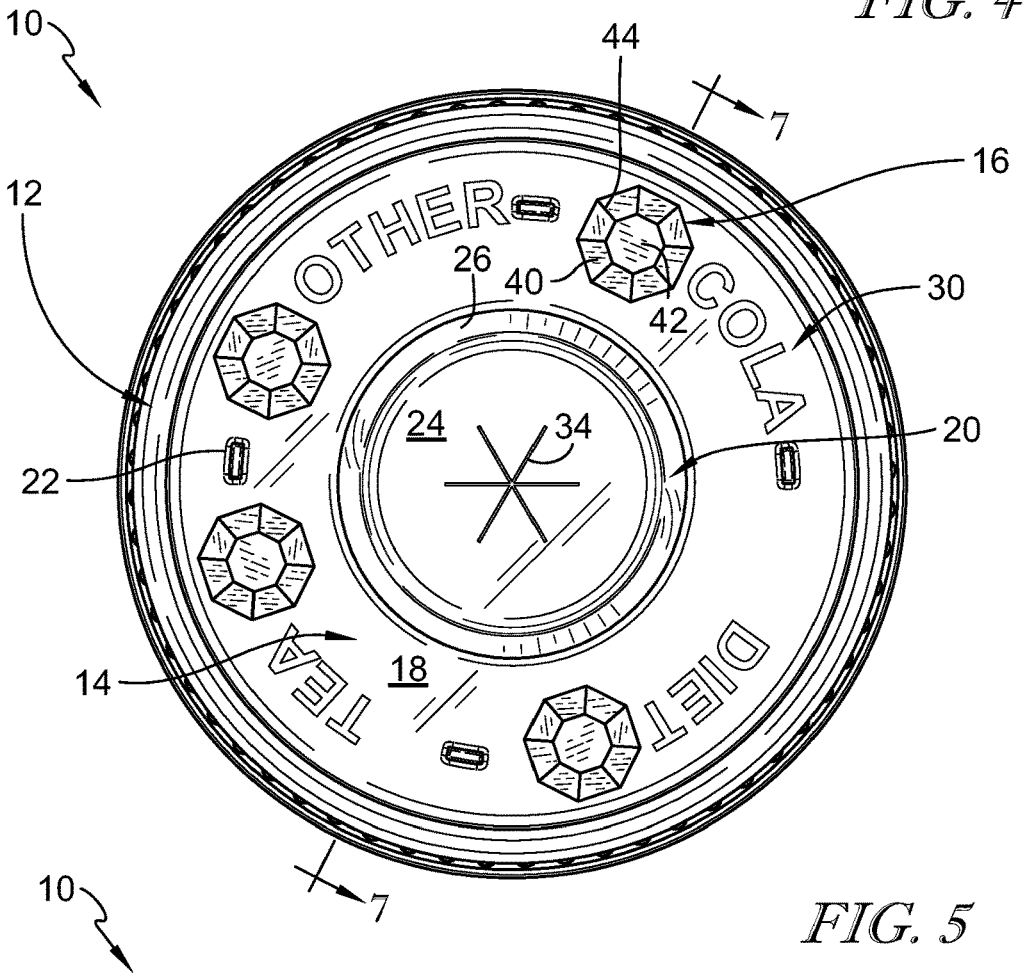
FIG. 5 is a top plan view of the drink cup lid of FIG. 4 showing that the liquid-retainer floor illustratively includes indicia such as text associated with selectable contents of the cup and the product-identification domes and the indicia cooperate to indicate visually the selected contents of the cup.
Figure 6:
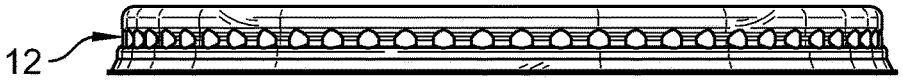
FIG. 6 is a front elevation view of the drink cup lid of FIG. 4 showing the brim mount of the drink cup lid and suggesting that the product-identification domes do not extend upwardly away from the cup beyond a top surface of the brim mount.

Central closure 14 illustratively includes a liquid-retainer floor 18, an elevated basin 20, and stack-assist nubs 22 as shown in FIGS. 4 and 5. Liquid-retainer floor 18 extends radially inward from brim mount 12 toward elevated basin 20. Elevated basin 20 extends upwardly away from liquid-retainer floor 18 and includes a straw cut 34. Stack-assist nubs 22 are located radially between brim mount 12 and elevated basin 20 and extend upwardly away from liquid-retainer floor 18 to assist in nesting multiple drink cup lids 10 to form a stack of drink cup lids 10 and in un-stacking multiple nested drink cup lids 10.

Liquid-retainer floor 18 is arranged to collect spilled liquid between brim mount 12 and elevated basin 20 as suggested in FIG. 4. In the illustrative embodiment, liquid-retainer floor 18 is formed to include indicia 30 that correspond to potential flavors of liquid beverages commonly stored in cup 112. In the illustrative embodiment, indicia 30 comprise raised text corresponding to cola, diet, tea, and other flavors of liquid beverages. Indicia 30 cooperate with product-identification domes 16 to communicate visually to a consumer that the liquid beverage contained in cup 112 should have a flavor corresponding to indicia 30 adjacent a deformed product-identification dome 16.

Elevated basin 20 includes a raised floor 24 and a curved liquid-retaining wall 26 as shown in FIGS. 4-5. Raised floor 24 is coupled to curved liquid-retaining wall 26 and includes straw cut 34. Curved liquid-retaining wall 26 extends between and interconnects liquid-retainer floor 18 and raised floor 24. Illustratively, curved liquid-retaining wall 26 has an angle of less than 90 degrees relative to liquid-retainer floor 18 to direct liquid spilled onto raised floor 24 downward onto liquid-retainer floor 18.

As shown in FIGS. 4 and 5, each deformable product-identification dome 16 is spaced apart circumferentially from neighboring deformable product-identification domes 16. Each deformable product-identification dome 16 is configured to move from the un-deformed arrangement, shown in FIGS. 2 and 7, to the deformed arrangement, shown in FIGS. 3 and 8, in response to downward deformation force 32.

Figure 7:
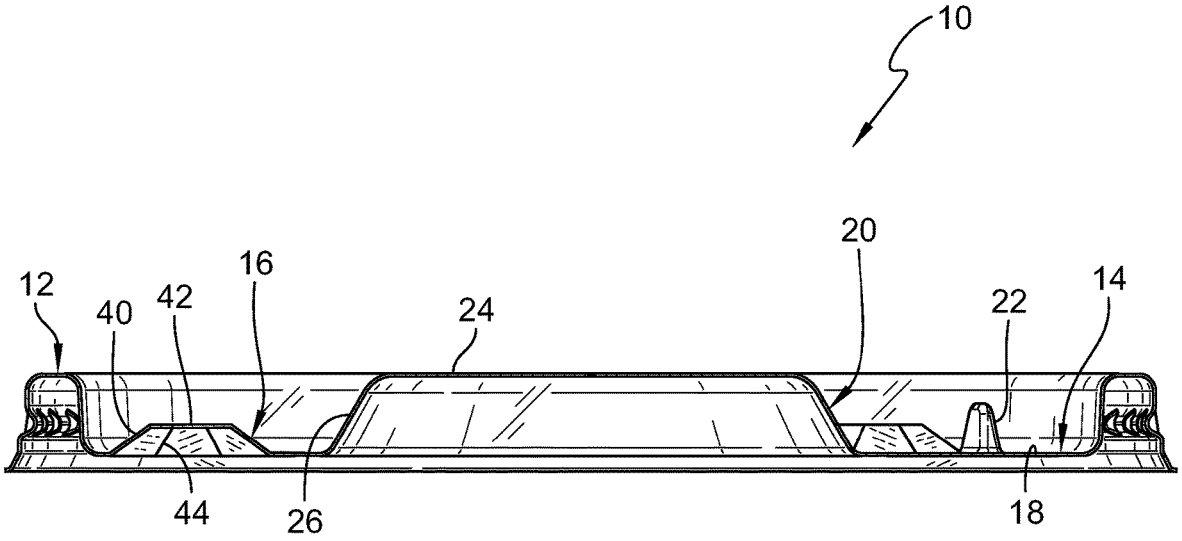
FIG. 7 is a sectional view taken along line 7-7 of FIG. 5 showing one of the product-identification domes included in the drink cup lid in the un-deformed arrangement in which the product-identification dome extends upwardly away from the cup and suggesting that the product-identification dome is transparent in the un-deformed arrangement.
Figure 8:
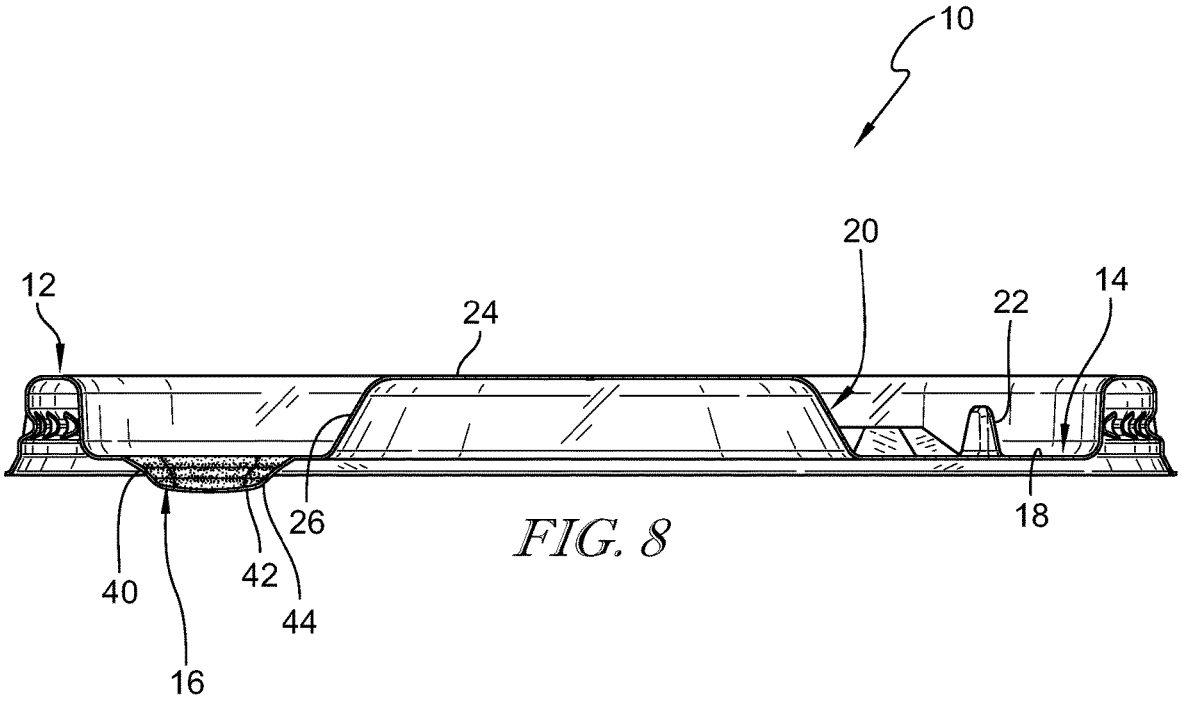
FIG. 8 is a view similar to FIG. 7 after the product-identification dome has been deformed to assume the deformed arrangement in which the product-identification dome extends downwardly toward the cup and suggesting that the product-identification dome is relatively opaque in the deformed arrangement.

As shown in FIG. 7, in the un-deformed arrangement, product-identification dome 16 is transparent and extends upwardly away from liquid-retainer floor 18. In use, a user may apply downward deformation force 32 to deformable product-identification dome 16 causing deformable product-identification dome 16 to deform to assume the deformed arrangement as suggested in FIGS. 3 and 8. In the deformed arrangement, deformable product-identification dome 16 extends downwardly away from liquid-retainer floor 18 toward the floor of cup 112. In the deformed arrangement, product-identification dome 16 is less transparent than in the un-deformed arrangement and/or at least partially opaque to indicate visually a selected content of cup 112.

Product-identification dome 16 is configured to move to an un-deformed returned arrangement from the deformed arrangement in response to an upward return force. Surprisingly, it was found that in some example, some areas of the product-identification dome 16 that were at least partially opaque in the deformed arrangement become less opaque or become transparent in the un-deformed returned arrangement. In some embodiments, the product-identification dome 16 is transparent in the un-deformed return arrangement. In some embodiments, the product-identification dome 16 is partially transparent in the un-deformed return arrangement.

The illustrative product-identification dome 16 includes the plurality of panels 40 and dome cap 42 as shown in FIG. 2. Panels 40 are appended to liquid-retainer floor 18 and extend upwardly away from liquid-retainer floor 18 in a circular pattern. Dome cap 42 is located in spaced apart relation to liquid-retainer floor 18 and extends between and interconnects panels 40.

Each panel 40 is illustratively trapezoidal. In the illustrative embodiment, deformable product-identification dome 16 includes eight panels 40 as shown in FIGS. 4 and 5. In other embodiments, deformable product-identification dome 16 includes any number of panels 40. Dome cap 42 is octagon shaped and coupled to each of the eight panels 40.

Adjacent panels 40 are coupled to one another at stress concentrator joints 44 as shown in FIGS. 2 and 5. Panels 40 are further coupled to dome cap 42 at stress concentrator joints 44. Stress concentrator joints 44 focus stresses in the material of product-identification dome 16 in response to deformation of product-identification dome 16 to cause the transparency of product-identification dome 16 to change in response to moving from the un-deformed arrangement to the deformed arrangement. Stress concentrator joints 44 may be formed by a plurality of geometry arrangements that focus stress when product-identification dome 16 is deformed. In the illustrative embodiment, adjacent panels 40 are coupled to one another along linear geometries to form stress concentrator joints 44. In contrast, hemispherical product-identification domes may lack stress concentrator joints 44.

As suggested in FIG. 3, stress concentrator joints 44 of one of the product-identification domes 16 are transparent when the product-identification dome 16 is in the un-deformed arrangement and are opaque when the product-identification dome is in the deformed arrangement. Illustratively, stress concentrator joints 44 cause opaque rings 36 to form in product-identification dome 16 when product-identification dome 16 is in the deformed arrangement. The opaque rings may become transparent and/or become undetectable visually when product-identification dome 16 is in the un-deformed returned arrangement.

In other embodiments, product-identification domes 16 include other stress concentrator features in addition to or instead of stress concentrator joints 44 as suggested in FIGS. 9-16. Stress concentrator features focus stresses in the material of product-identification dome 16 in response to deformation of product-identification dome 16 to cause the transparency of product-identification dome 16 to change in response to moving from the un-deformed arrangement to the deformed arrangement. Stress concentrator features may include depressions, deformations, or geometric formations in product-identification domes 16.

Figure 14:
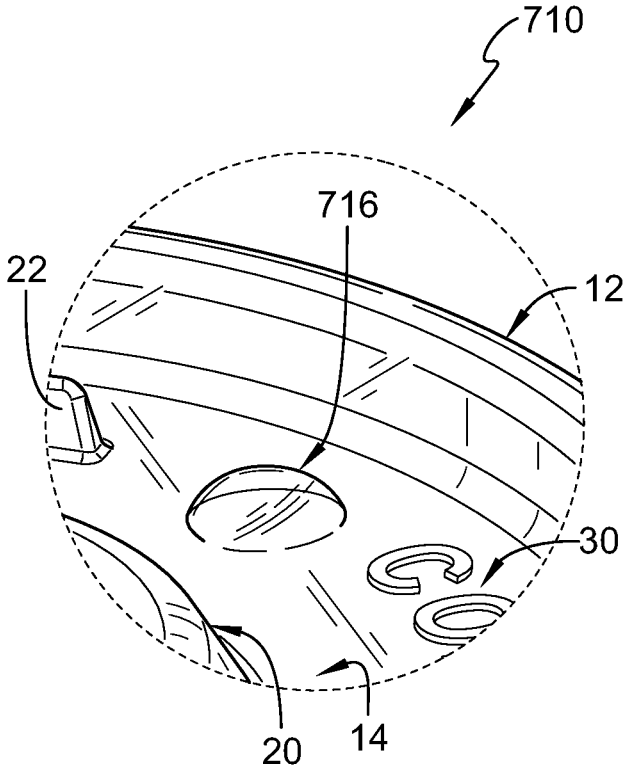
FIG. 14 is an enlarged partial perspective view of a seventh embodiment of a drink cup lid in accordance with the present disclosure showing that the drink cup lid includes a seventh embodiment of a product-identification dome.

In some embodiments, product-identification domes 16 are hemispherical and do not include stress concentrator joints 44 or stress concentrator features as shown in FIG. 14. In such embodiments, product-identification domes 16 may not change transparency in response to deformation of product-identification dome 16 moving from the un-deformed arrangement to the deformed arrangement.

In illustrative embodiments, drink cup lid 10 is transparent to allow a consumer to view contents of interior liquid-storage region 118 of cup 112 through drink cup lid 10. In accordance with the present disclosure, the term transparent incorporates a range of transparency values including translucent to fully transparent values. Furthermore, the term transparent encompasses transmittance, wide angle scattering (sometimes referred to as haze), narrow angle scattering (sometimes referred to as clarity or see-through quality), and any other factor affecting the ability to see through drink cup lid 10. In other embodiments, drink cup lid 10 is not transparent.

In some embodiments, each product-identification dome 16 is less transparent in the deformed arrangement than the un-deformed arrangement to indicate visually a selected flavor of a liquid beverage stored in interior liquid-storage region 118 of cup 112. In some embodiments, each product-identification dome 16 is relatively opaque in the deformed arrangement as compared to the un-deformed arrangement to indicate visually a selected flavor of a liquid beverage stored in interior liquid-storage region 118 of cup 112. In some embodiments, each product-identification dome 16 has portions that are transparent and portions that are relatively opaque in the deformed arrangement as compared to having all portions being relatively transparent in the un-deformed arrangement to indicate visually a selected flavor of a liquid beverage stored in interior liquid-storage region 118 of cup 112. A consumer may be able to see through product-identification domes 16 when product-identification domes 16 are in the un-deformed arrangement and the deformed arrangement.

The clarity of drink cup lid 10 as discussed herein is measured using ASTM D 1746 which is hereby incorporated by reference herein in its entirety. In some examples, the clarity of drink cup lid 10 is in a range of about 40% to about 95%. In some examples, the clarity of drink cup lid 10 is in a range of about 50% to about 95%. In some embodiments, the clarity of drink cup lid 10 is in a range of about 55% to about 95%. In some embodiments, the clarity of drink cup lid 10 is in a range of about 60% to about 95%. In some embodiments, the clarity of drink cup lid 10 is in a range of about 55% to about 65%. In some embodiments, the clarity of drink cup lid 10 is in a range of about 65% to about 75%. In some embodiments, the clarity of drink cup lid 10 is in a range of about 70% to about 95%. In some embodiments, the clarity of drink cup lid 10 is in a range of about 70% to about 90%. In some embodiments, the clarity of drink cup lid 10 is in a range of about 70% to about 85%. In some embodiments, the clarity of drink cup lid 10 is in a range of about 70% to about 80%. In some embodiments, the clarity of drink cup lid 10 is in a range of about 65% to about 85%.

In illustrative embodiments, the clarity of drink cup lid 10 is greater than about 70%. In some embodiments, the clarity of drink cup lid 10 is greater than about 60%. In some embodiments, the clarity of drink cup lid 10 is greater than about 65%. In some embodiments, the clarity of drink cup lid 10 is greater than about 75%.

In some examples, the clarity of drink cup lid 10 is about 56.2%. In some examples, the clarity of drink cup lid 10 is about 58.5%. In some examples, the clarity of drink cup lid 10 is about 63.7%. In some examples, the clarity of drink cup lid 10 is about 60.2%. In some examples, the clarity of drink cup lid 10 is about 70.2%. In some examples, the clarity of drink cup lid 10 is about 80.9%. In some examples, the clarity of drink cup lid 10 is about 94.8%. In some examples, the clarity of drink cup lid 10 is about 74.2%. In some examples, the clarity of drink cup lid 10 is about 71.2%. In some examples, the clarity of drink cup lid 10 is about 70.3%. In some examples, the clarity of drink cup lid 10 is about 65.8%.

The haze of drink cup lid 10 as discussed herein is measured using ASTM D 1003 procedure B which is hereby incorporated by reference herein in its entirety. In some examples, the haze of drink cup lid 10 is in a range of about 10% to about 60%. In some examples, the haze of drink cup lid 10 is in a range of about 10% to about 40%. In some examples, the haze of drink cup lid 10 is in a range of about 20% to about 38%. In some examples, the haze of drink cup lid 10 is in a range of about 20% to about 40%. In some examples, the haze of drink cup lid 10 is in a range of about 30% to about 40%. In some examples, the haze of drink cup lid 10 is in a range of about 14% to about 25%. In some examples, the haze of drink cup lid 10 is in a range of about 0% to about 30%. In some examples, the haze of drink cup lid 10 is in a range of about 10% to about 30%. In some examples, the haze of drink cup lid 10 is in a range of about 20% to about 28%.

In illustrative embodiments, the haze of drink cup lid 10 is less than about 30%. In some embodiments, the haze of drink cup lid 10 is less than about 29%. In illustrative embodiments, the haze of drink cup lid 10 is less than about 28%. In illustrative embodiments, the haze of drink cup lid 10 is less than about 40%.

In some examples, the haze of drink cup lid 10 is about 36.9%. In some examples, the haze of drink cup lid 10 is about 23.0%. In some examples, the haze of drink cup lid 10 is about 21.5%. In some examples, the haze of drink cup lid 10 is about 20.2%. In some examples, the haze of drink cup lid 10 is about 23.5%. In some examples, the haze of drink cup lid 10 is about 18.8%. In some examples, the haze of drink cup lid 10 is about 14.1%. In some examples, the haze of drink cup lid 10 is about 28.3%. In some examples, the haze of drink cup lid 10 is about 31.4%. In some examples, the haze of drink cup lid 10 is about 32.4%. In some examples, the haze of drink cup lid 10 is about 32.8%.

In some examples, the clarity of drink cup lid 10 is greater than about 70% and the haze is less than about 30%. In some examples, the clarity of drink cup lid is about 74.2% and the haze is about 28.3%. Product-identification domes 16 share the clarity and haze values of drink cup lid 10 when product-identification domes 16 are in the first arrangement. In other words, product-identification domes 16 share the clarity and haze values of drink cup lid 10 before product-identification domes 16 are depressed downward.

In some embodiments, drink cup lids 10 have a thickness of between about five and about twenty thousandths of an inch. In some embodiments, drink cup lids 10 have a thickness of between about five and about fifteen thousandths of an inch. In some embodiments, drink cup lids 10 have a thickness of between about ten and about eleven thousandths of an inch. In some embodiments, drink cup lids 10 have a thickness of between about one and about fifteen thousandths of an inch. In some embodiments, drink cup lids 10 have a thickness of between about one and about nine thousandths of an inch. In some embodiments, drink cup lids 10 have a thickness of about six thousandths of an inch. In some embodiments, drink cup lids 10 have a thickness of about nine thousandths of an inch. In some embodiments, drink cup lids 10 have a thickness of between about eight and about nine thousandths of an inch.

Drink cup lid 10 is made of non-aromatic materials. As such, drink cup lid 10 is free from polystyrene. Drink cup lid 10 is free from aromatic materials. As used herein, the term non-aromatic polymer refers to a polymer that is devoid of aromatic ring structures (e.g., phenyl groups) in its polymer chain.

Aromatic molecules typically display enhanced hydrophobicity when compared to non-aromatic molecules. As a result, it would be expected that a polypropylene-based polymeric material instead of a polystyrene-based polymeric material would result in a change in hydrophobicity with a concomitant, but not necessarily predictable or desirable, change in surface adsorption properties of the resulting material. In addition, by virtue of the hydrocarbon chain in polystyrene, wherein alternating carbon centers are attached to phenyl groups, neighboring phenyl groups can engage in so-called pi-stacking, which is a mechanism contributing to the high intramolecular strength of polystyrene and other aromatic polymers. No similar mechanism is available for non-aromatic polymers such as polypropylene. Moreover, notwithstanding similar chemical reactivity and chemical resistance properties of polystyrene and polypropylene, polystyrene can be either thermosetting or thermoplastic when manufactured whereas polypropylene is exclusively thermoplastic. As a result, to the extent that surface adsorption properties, manufacturing options, and strength properties similar to those of polystyrene are sought, likely alternatives to polystyrene-based polymeric materials would be found in another aromatic polymer rather than in a non-aromatic polymer.

The use of non-aromatic materials may affect recyclability, insulation, microwavability, impact resistance, or other properties. At least one potential feature of an article formed of non-aromatic polymeric material according to various aspects of the present disclosure is that the article can be recycled. Recyclable means that a material can be added (such as regrind) back into an extrusion or other formation process without segregation of components of the material, i.e., an article formed of the material does not have to be manipulated to remove one or more materials or components prior to re-entering the extrusion process. In contrast, a polystyrene lid may not be recyclable. In one example, a lid and a cup made from non-aromatic or styrene-free materials may simplify recycling.

Figure 9:
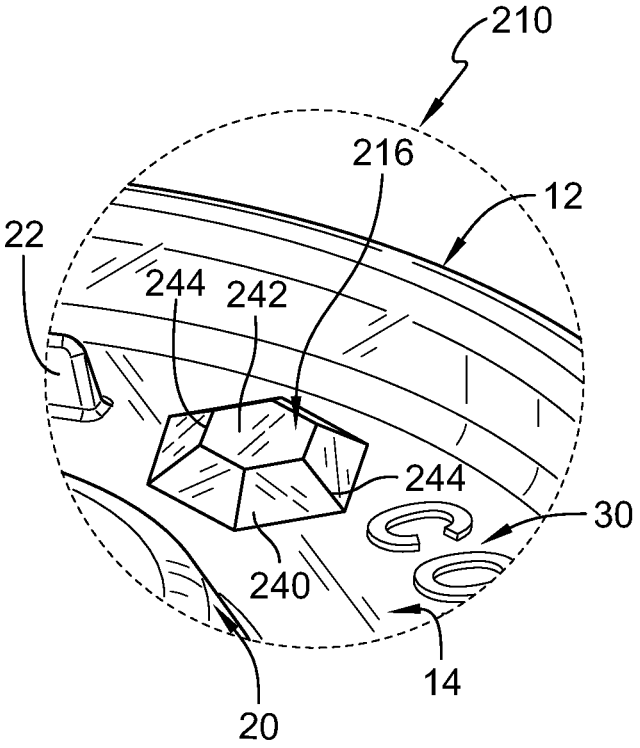
FIG. 9 is an enlarged partial perspective view of a second embodiment of a drink cup lid in accordance with the present disclosure showing that the drink cup lid includes a second embodiment of a product-identification dome.

Another embodiment of a drink cup lid 210 in accordance with the present disclosure is shown in FIG. 9. Drink cup lid 210 includes brim mount 12, central closure 14, and at least one deformable product-identification dome 216.

Product-identification dome 216 includes a plurality of panels 240 and a dome cap 242 as shown in FIG. 9. Panels 240 are appended to liquid-retainer floor 18 of central closure 14 and extend upwardly away from liquid-retainer floor 18 in a circular pattern. Dome cap 242 is located in spaced apart relation to liquid-retainer floor 18 and extends between and interconnect panels 240.

Deformable product-identification dome 216 includes six panels 240 as shown in FIG. 9. Each panel 240 is trapezoidal. Dome cap 242 is hexagon shaped and is coupled to each of the six panels 240. Adjacent panels 240 are coupled to one another at stress concentrator joints 244. Panels 240 are further coupled to dome cap 242 at stress concentrator joints 244. Stress concentrator joints 244 focus stresses in the material of product-identification dome 216 in response to deformation of product-identification dome 216 to cause the transparency of product-identification dome 216 to change in response to moving from the un-deformed arrangement to the deformed arrangement.

Figure 10:
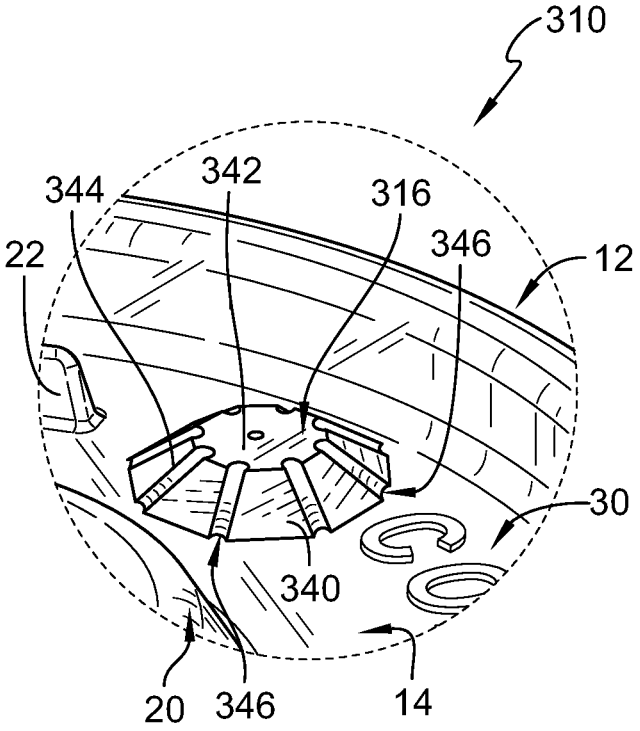
FIG. 10 is an enlarged partial perspective view of a third embodiment of a drink cup lid in accordance with the present disclosure showing that the drink cup lid includes a third embodiment of a product-identification dome.

Another embodiment of a drink cup lid 310 in accordance with the present disclosure is shown in FIG. 10. Drink cup lid 310 includes brim mount 12, central closure 14, and at least one deformable product-identification dome 316.

Product-identification dome 316 includes a plurality of panels 340 and a dome cap 342 as shown in FIG. 10. Panels 340 are appended to liquid-retainer floor 18 of central closure 14 and extend upwardly away from liquid-retainer floor 18 in a circular pattern. Dome cap 342 is located in spaced apart relation to liquid-retainer floor 18 and extends between and interconnect panels 340.

Deformable product-identification dome 316 includes eight panels 340 as shown in FIG. 10. Each panel 340 is trapezoidal. Dome cap 342 is octagon shaped and is coupled to each of the eight panels 340. Adjacent panels 340 are coupled to one another at stress concentrator joints 344. Panels 340 are further coupled to dome cap 342 at stress concentrator joints 344.

As shown in FIG. 10, deformable product-identification dome 316 includes a plurality of stress concentrator features 346 aligned with stress concentrator joints 344 formed between adjacent panels 340. Stress concentrator features 346 define channels 346 arranged to extend into deformable product-identification dome 316 toward central closure 14. Illustratively, channels 346 extend partway into dome cap 342.

Figure 11:
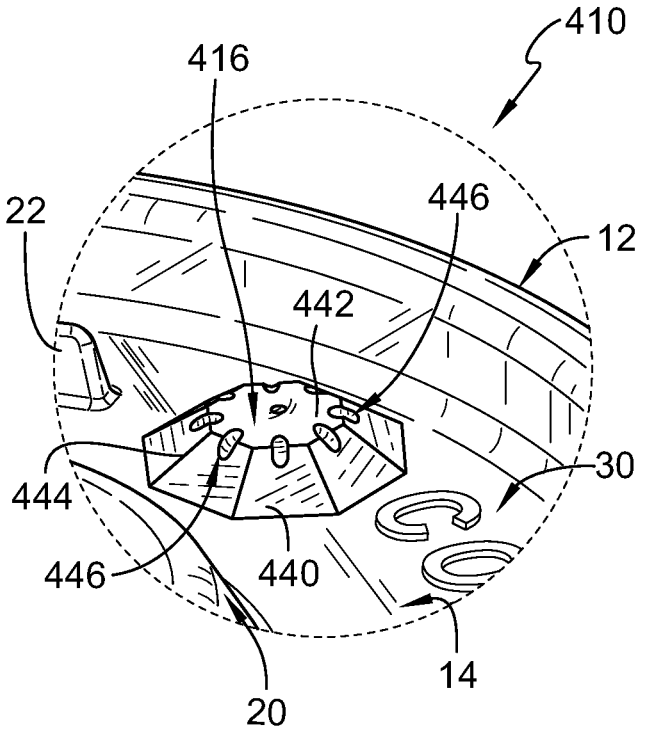
FIG. 11 is an enlarged partial perspective view of a fourth embodiment of a drink cup lid in accordance with the present disclosure showing that the drink cup lid includes a fourth embodiment of a product-identification dome.

Another embodiment of a drink cup lid 410 in accordance with the present disclosure is shown in FIG. 11. Drink cup lid 410 includes brim mount 12, central closure 14, and at least one deformable product-identification dome 416.

Product-identification dome 416 includes a plurality of panels 440 and a dome cap 442 as shown in FIG. 11. Panels 440 are appended to liquid-retainer floor 18 of central closure 14 and extend upwardly away from liquid-retainer floor 18 in a circular pattern. Dome cap 442 is located in spaced apart relation to liquid-retainer floor 18 and extends between and interconnect panels 440.

Deformable product-identification dome 416 includes eight panels 440 as shown in FIG. 11. Each panel 440 is trapezoidal. Dome cap 442 is octagon shaped and is coupled to each of the eight panels 440. Adjacent panels 440 are coupled to one another at stress concentrator joints 444. Panels 440 are further coupled to dome cap 442 at stress concentrator joints 444.

As shown in FIG. 11, deformable product-identification dome 416 includes a plurality of stress concentrator features 446. Stress concentrator features define wedge-shaped depressions 446 that extend into panels 440 and dome cap 442 toward central closure 14. In the illustrative embodiment, wedge-shaped depressions 446 are located at about a midpoint of each panel 440 and extend radially partway into dome cap 442 and partway down each panel 440 toward liquid-retainer floor 18. In the illustrative embodiment, each wedge-shaped depressions 446 has a width equal to about one-third of a width of one of the panels 440.

Figure 12:
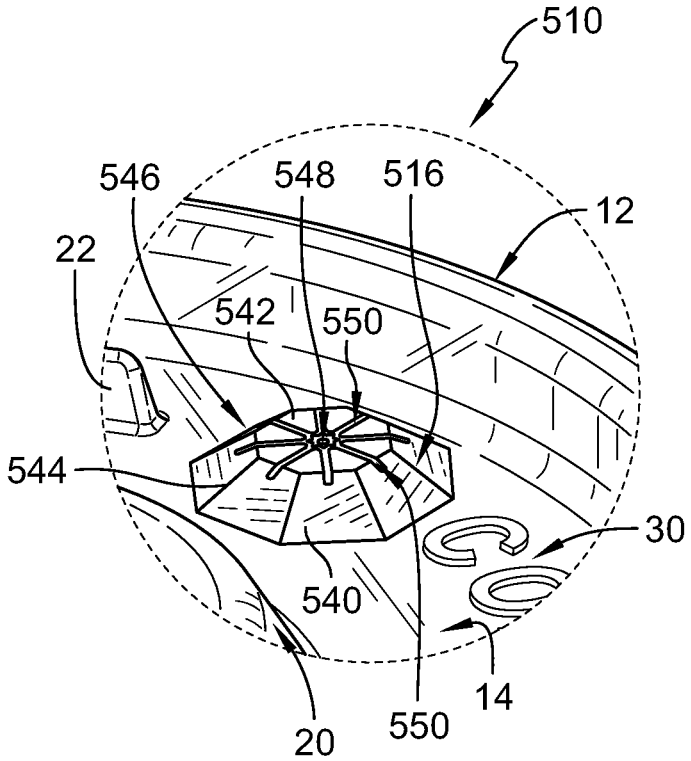
FIG. 12 is an enlarged partial perspective view of a fifth embodiment of a drink cup lid in accordance with the present disclosure showing that the drink cup lid includes a fifth embodiment of a product-identification dome.

Another embodiment of a drink cup lid 510 in accordance with the present disclosure is shown in FIG. 12. Drink cup lid 510 includes brim mount 12, central closure 14, and at least one deformable product-identification dome 516.

Product-identification dome 516 includes a plurality of panels 540 and a dome cap 542 as shown in FIG. 12. Panels 540 are appended to liquid-retainer floor 18 of central closure 14 and extend upwardly away from liquid-retainer floor 18 in a circular pattern. Dome cap 542 is located in spaced apart relation to liquid-retainer floor 18 and extends between and interconnect panels 540.

Deformable product-identification dome 516 includes eight panels 540 as shown in FIG. 12. Each panel 540 is trapezoidal. Dome cap 542 is octagon shaped and is coupled to each of the eight panels 540. Adjacent panels 540 are coupled to one another at stress concentrator joints 544. Panels 540 are further coupled to dome cap 542 at stress concentrator joints 544.

As shown in FIG. 12, deformable product-identification dome 516 includes a plurality of stress concentrator features 546. Stress concentrator features 546 include a central depression 548 formed in dome cap 542 and channels 550 that extend radially away from central depression 548. Central depression 548 is formed in about a center of dome cap 542. Channels 550 are arranged in a radial-spoke pattern around central depression 548. Each channel 550 extends into dome cap 542 toward central closure 14 and each channel 550 extends partway into a corresponding panel 540.

Figure 13:
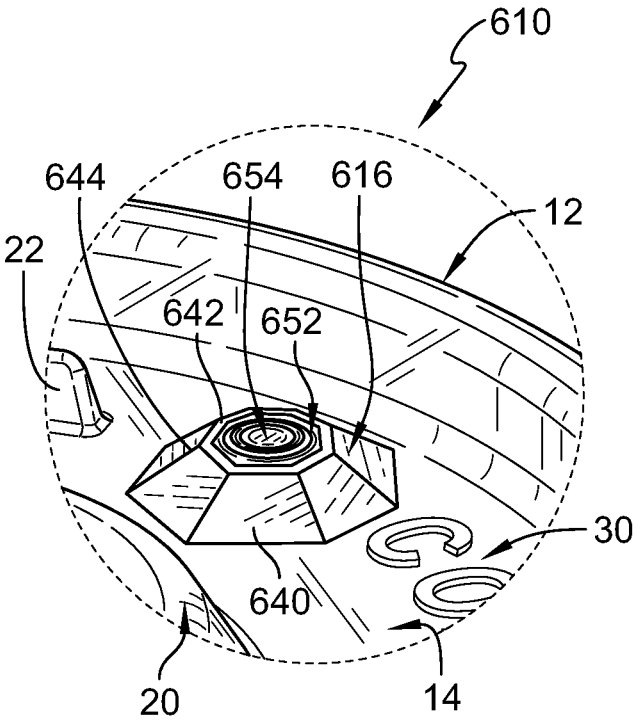
FIG. 13 is an enlarged partial perspective view of a sixth embodiment of a drink cup lid in accordance with the present disclosure showing that the drink cup lid includes a sixth embodiment of a product-identification dome.

Another embodiment of a drink cup lid 610 in accordance with the present disclosure is shown in FIG. 13. Drink cup lid 610 includes brim mount 12, central closure 14, and at least one deformable product-identification dome 616.

Product-identification dome 616 includes a plurality of panels 640 and a dome cap 642 as shown in FIG. 13. Panels 640 are appended to liquid-retainer floor 18 of central closure 14 and extend upwardly away from liquid-retainer floor 18 in a circular pattern. Dome cap 642 is located in spaced apart relation to liquid-retainer floor 18 and extends between and interconnect panels 640.

Deformable product-identification dome 616 includes eight panels 640 as shown in FIG. 13. Each panel 640 is trapezoidal. Dome cap 642 is octagon shaped and is coupled to each of the eight panels 640. Adjacent panels 640 are coupled to one another at stress concentrator joints 644. Panels 640 are further coupled to dome cap 642 at stress concentrator joints 644. As shown in FIG. 13, dome cap 642 is formed to include an annular depression 652 that extends downward into dome cap 642 toward central closure 14 to define a central circular shaped portion 654 of dome cap 642.

Another embodiment of a drink cup lid 710 in accordance with the present disclosure is shown in FIG. 14. Drink cup lid 710 includes brim mount 12, central closure 14, and at least one deformable product-identification dome 716. Deformable product-identification dome 716 is curved and appended to central closure 14. Illustratively, deformable product-identification dome 716 is hemispherical.

As shown in FIG. 14, deformable product-identification dome 716 lacks stress concentrator joints. Illustratively, deformable product-identification dome 716 may not change in transparency when moving from the un-deformed arrangement to the deformed arrangement. Furthermore, deformable product-identification dome 716 may not change in transparency when moving from the deformed arrangement to the un-deformed arrangement.

In other embodiments, deformable product-identification dome 716 has a relatively small change in transparency when moving from the deformed arrangement to the un-deformed arrangement as compared to other deformable product-identification domes 16, 216, 316, 416, 516, 616, 816, 916, 1016 that include stress concentrator joints. Any change in transparency in deformable product-identification dome 716 may be reversed when deformable product-identification dome 716 moves from the deformed arrangement to the un-deformed arrangement.

Figure 15:
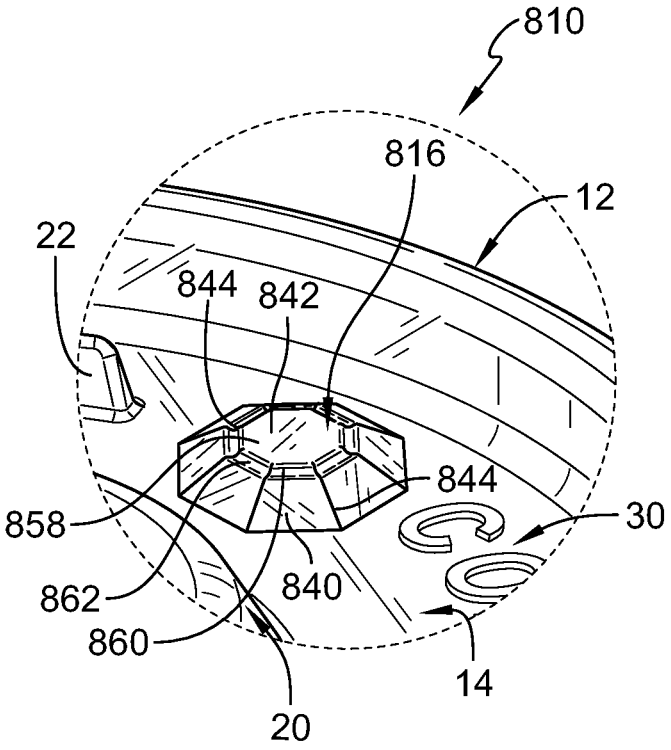
FIG. 15 is an enlarged partial perspective view of an eighth embodiment of a drink cup lid in accordance with the present disclosure showing that the drink cup lid includes an eighth embodiment of a product-identification dome.

Another embodiment of a drink cup lid 810 in accordance with the present disclosure is shown in FIG. 15. Drink cup lid 810 includes brim mount 12, central closure 14, and at least one deformable product-identification dome 816.

Product-identification dome 816 includes a plurality of panels 840 and a dome cap 842 as shown in FIG. 15. Panels 840 are appended to liquid-retainer floor 18 of central closure 14 and extend upwardly away from liquid-retainer floor 18 in a circular pattern. Dome cap 842 is located in spaced apart relation to liquid-retainer floor 18 and extends between and interconnects panels 840. Panels 840 are further coupled to dome cap 842 at stress concentrator joints 844.

Deformable product-identification dome 816 includes eight panels 840 as shown in FIG. 15. Each panel 840 is trapezoidal. Adjacent panels 840 are coupled to one another at stress concentrator joints 844. Stress concentrator joints 844 are linear in the illustrative embodiment.

Dome cap 842 is octagon shaped and is coupled to each of the eight panels 840 as shown in FIG. 15. Dome cap 842 includes an upper surface 858, a side surface 860, and a lower surface 862. Side surface 860 extends between and interconnects upper surface 858 and lower surface 862. Lower surface 862 may experience a greater reduction in transparency as compared to the side surface 862 and upper surface 858 when deformable product-identification dome 816 is depressed. Upper surface 858 and lower surface have octagonal perimeters.

Figure 16:
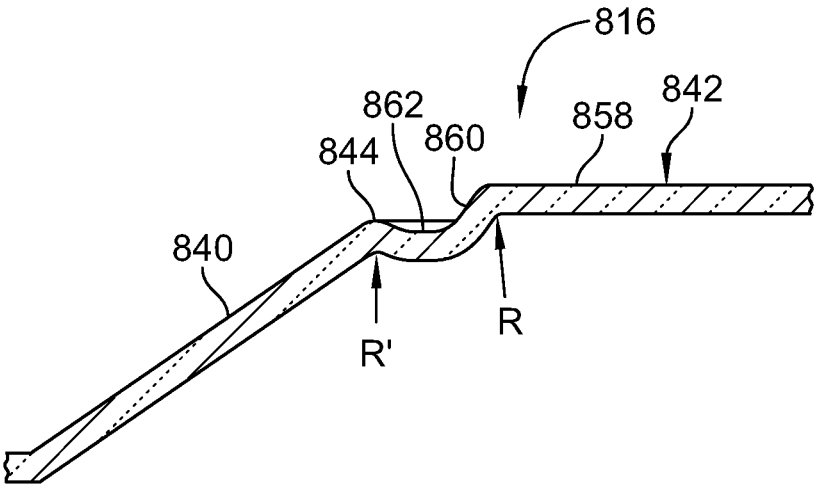
FIG. 16 is a partial section view of the eighth embodiment of the product-identification dome shown in FIG. 15 showing that features of the eighth embodiment of the product identification dome include rounded or curvilinear edges.

Side surface 860 is coupled to upper surface 858 about a curved edge having a radius R as shown in FIG. 16. Lower surface 862 is coupled to and interconnects side surface 860 and each of the panels 840 about a curved edge having a radius R'. Radius R may be a constant radius or a varying radius of curvature. Radius R' may be a constant radius or a varying radius of curvature. The curved edges may minimize cracking of the material forming product-identification dome 816 at and around the edges even if product-identification dome 816 has never been depressed.

Figure 17:
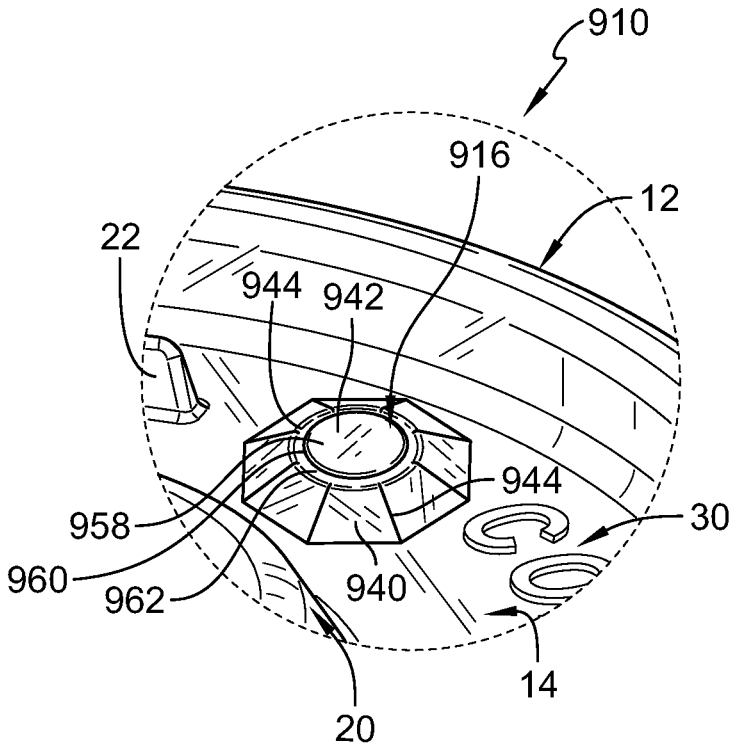
FIG. 17 is an enlarged partial perspective view of a ninth embodiment of a drink cup lid in accordance with the present disclosure showing that the drink cup lid includes a ninth embodiment of a product-identification dome.

Another embodiment of a drink cup lid 910 in accordance with the present disclosure is shown in FIG. 17. Drink cup lid 910 includes brim mount 12, central closure 14, and at least one deformable product-identification dome 916.

Product-identification dome 916 includes a plurality of panels 940 and a dome cap 942 as shown in FIG. 17. Panels 940 are appended to liquid-retainer floor 18 of central closure 14 and extend upwardly away from liquid-retainer floor 18 in a circular pattern. Dome cap 942 is located in spaced apart relation to liquid-retainer floor 18 and extends between and interconnects panels 940. Panels 940 are further coupled to dome cap 942 at stress concentrator joints 944.

Deformable product-identification dome 916 includes eight panels 940 as shown in FIG. 17. Each panel 940 is generally trapezoidal. Adjacent panels 940 are coupled to one another at linear stress concentrator joints 944.

Dome cap 942 is circular shaped and is coupled to each of the eight panels 940 as shown in FIG. 17. Dome cap 942 includes an upper surface 958, a side surface 960, and a lower surface 962. Side surface 960 extends between and interconnects upper surface 958 and lower surface 962. Upper surface 958 and lower surface have generally circular perimeters and are rounded at the edges to be curvilinear similar to FIG. 16. The curved edges may minimize cracking of the material forming product-identification dome 916 at and around the edges.

Figure 18:
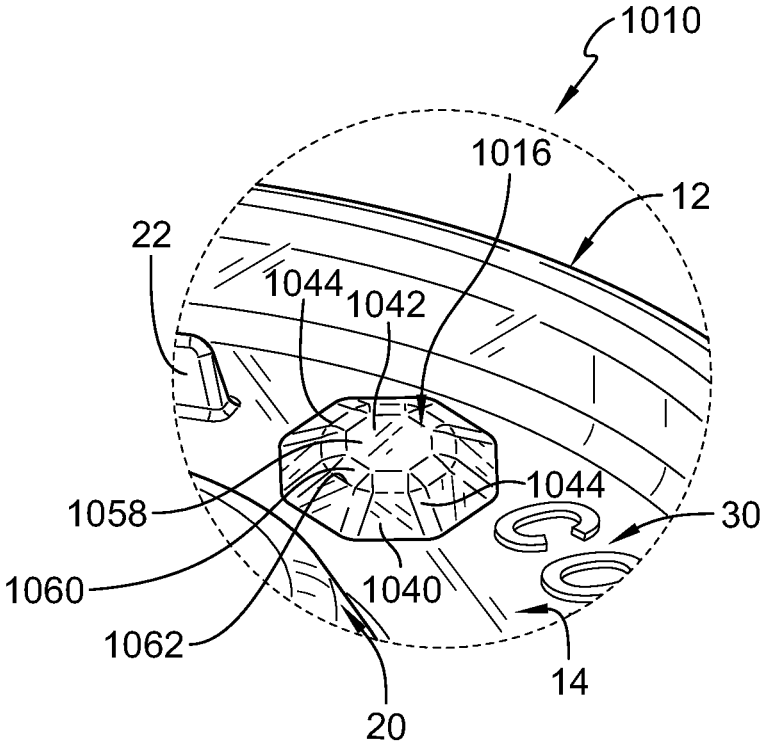
FIG. 18 is an enlarged partial perspective view of a tenth embodiment of a drink cup lid in accordance with the present disclosure showing that the drink cup lid includes a tenth embodiment of a product-identification dome.

Another embodiment of a drink cup lid 1010 in accordance with the present disclosure is shown in FIG. 18. Drink cup lid 1010 includes brim mount 12, central closure 14, and at least one deformable product-identification dome 1016.

Product-identification dome 1016 includes a plurality of panels 1040 and a dome cap 1042 as shown in FIG. 18. Panels 1040 are appended to liquid-retainer floor 18 of central closure 14 and extend upwardly away from liquid-retainer floor 18 in a circular pattern. Dome cap 1042 is located in spaced apart relation to liquid-retainer floor 18 and extends between and interconnects panels 1040. Panels 1040 are further coupled to dome cap 1042 at stress concentrator joints 1044.

Deformable product-identification dome 1016 includes eight panels 1040 as shown in FIG. 18. Each panel 1040 is generally trapezoidal. Adjacent panels 1040 are coupled to one another at curved stress concentrator joints 1044. Stress concentrator joints 1044 are curvilinear in the illustrative embodiment.

Dome cap 1042 is octagon shaped and is coupled to each of the eight panels 1040 as shown in FIG. 18. Dome cap 1042 includes an upper surface 1058, a side surface 1060, and a lower surface 1062. Side surface 1060 extends between and interconnects upper surface 1058 and lower surface 1062. Upper surface 1058 and lower surface have generally octagonal perimeters, but are rounded at the edges to be curvilinear. The curved edges may minimize cracking of the material forming product-identification dome 1016 at and around the edges.

Drink cup lids 10, 210, 310, 410, 510, 610, 710, 810, 910, 1010 are made, for example, by thermoforming a sheet in a lid-manufacturing process in accordance with the illustrative embodiments of the present disclosure. The lid-manufacturing process may include an extruding stage, a thermoforming stage, a cutting stage, and a packaging stage. In some embodiments, the sheet is a single-layer sheet that comprises a polymeric mixture. In other embodiments, the sheet is a multi-layer sheet. In one aspect, the polymeric mixture may be formed through an extrusion process of a formulation. In some embodiments, drink cup lids 10, 210, 310, 410, 510, 610, 710, 810, 910, 1010 are made from a polymeric non-aromatic sheet of material having a formulation.

Illustratively, the formulation for forming the sheet may be added to a hopper on an extrusion machine and heated to produce a molten material in an extruder. The molten material may be extruded to produce the single-layer sheet. In some embodiments, the single-layer sheet has a density between 0.8 g/cm$^3$ and 1.1 g/cm$^3$. In some embodiments, the single-layer sheet has a density of about 0.902 g/cm$^3$. In some embodiments, the single-layer sheet has a density of about 0.9 g/cm$^3$.

The polymeric mixture of the sheet may comprise, for example, a plastic polymer, a material, or a resin, and may optionally include one or more additives. Examples of plastic polymers, resins, or materials suitable for the single-layer sheet include high density polyethylene (HDPE), low density polyethylene (LDPE), polypropylene (PP), and copolymers of any combination of ethylene, propylene, butylene, and any other suitable alpha-olefin. In some aspects, the plastic polymer, material, or resin may be called a base resin.

In one aspect, the polypropylene may be a polypropylene homopolymer, a polypropylene copolymer, a polypropylene impact copolymer, or combinations thereof. In some embodiments, the polypropylene may contain an additive. In some aspects, the polypropylene copolymer is a random copolymer.

In some examples, the sheet comprises a polymeric mixture comprising a first polypropylene and a second polypropylene. In some examples, the first polypropylene may be a homopolymer. In some examples, the second polypropylene may be a polypropylene impact copolymer. In some examples, the sheet comprises a first polypropylene, a second polypropylene, and a polypropylene random copolymer.

In some examples, the polypropylene homopolymer may be a high crystallinity homopolymer. In some examples, the polypropylene homopolymer may comprise a nucleating agent. In some examples, the polypropylene homopolymer is Braskem INSPIRE™ 6025N.

In some examples, a polypropylene impact copolymer comprises a copolymer of ethylene and propylene. In some examples, a polypropylene impact copolymer is a heterophasic in-situ blend comprising an ethylene/propylene rubber (EPR) component. In some examples, a polypropylene impact copolymer is a heterophasic in-situ blend comprising an ethylene/propylene rubber (EPR) component distributed inside a semi-crystalline polypropylene homopolymer matrix. Illustratively, a polypropylene impact copolymer comprises a rubber phase and a polypropylene matrix phase. In some examples, a polypropylene impact copolymer may be produced with a Ziegler Natta catalyst. In some examples, a polypropylene impact copolymer is a semi-crystalline thermoplastic resin. In some examples, the polypropylene impact copolymer contains a nucleating agent. In some examples, the polypropylene impact copolymer is LyondellBasell Pro-Fax™ SC204.

In some embodiments, the sheet has a rubber content up to about 50% by weight of sheet. In some embodiments, the sheet comprises at least 0.05%, 1%, 2%, 3%, 4%, 5%, 6%, 7%, 8%, 9%, 10%, 12%, 14%, 16%, 18%, 20%, 25%, 30%, 35%, or 40% by weight rubber. In some embodiments, the rubber content of the sheet can be selected from a first series of ranges of about 0.5% to about 50%, about 0.5% to about 40%, about 0.5% to about 30%, about 0.5% to about 20%, about 0.5% to about 18%, about 0.5% to about 16%, about 0.5% to about 10%, or about 0.5% to about 5% by weight of the single-layer sheet. In some embodiments, the rubber content of the sheet can be selected from a second series of ranges of about 0.5% to about 20%, about 1% to about 20%, about 2% to about 20%, about 2.5% to about 20%, about 2.5% to about 20%, about 3% to about 20%, about 3.5% to about 20%, about 4% to about 20%, about 4.5% to about 20%, about 5% to about 20%, about 6% to about 20%, or about 7% to about 20% by weight of the sheet. In some embodiments, the rubber content of the sheet can be selected from a third series of ranges of about 0.5% to about 20%, about 1% to about 20%, about 1.5% to about 20%, about 2% to about 20%, about 2% to about 15%, about 2% to about 10%, about 2% to about 8%, or about 2% to about 5% by weight of the single-layer sheet. In some examples, the rubber content is about 0.5%, about 1%, about 1.5%, about 2%, about 2.5%, about 3%, about 3.5% about 4%, about 4.5% about 5%, about 6%, about 7%, about 7.5%, about 8%, about 8.5%, about 9%, about 9.5%, about 10%, about 12%, about 14%, about 16%, about 18%, about 20%, about 25%, about 30%, about 35%, about 40%, about 45%, or about 50% by weight of the sheet.

In some examples, the sheet comprises a polymeric mixture comprising a base resin and a secondary resin. Illustratively, the sheet may comprise up to 99% base resin. In some examples, the sheet may comprise up to 99% secondary resin. The sheet may comprise an amount of base resin selected from a range of about 5% to about 95%, about 10% to about 95%, about 10% to about 85%, about 20% to about 85%, about 20% to about 75%, about 30% to about 75%, about 40% to about 75%, or about 40% to about 60% by weight of sheet. In some embodiments, the sheet may comprise an amount of base resin selected from a range of about 15% to about 75%, about 15% to about 65%, about 15% to about 50%, about 20% to about 50%, or about 25% to about 45% by weight of sheet. The sheet may comprise an amount of base resin of about 5%, about 10%, about 15%, about 20%, about 25%, about 30%, about 35%, about 40%, about 45%, about 48%, about 49%, about 50%, about 51%, about 52%, about 55%, about 60%, about 65%, about 70%, about 80%, or about 95% by weight of sheet. The sheet may comprise an amount of secondary resin selected from a range of about 5% to about 95%, about 10% to about 95%, about 10% to about 85%, about 20% to about 85%, about 20% to about 75%, about 25% to about 70%, about 30% to about 75%, about 40% to about 75%, about 45% to about 65%, or about 40% to about 60% by weight of sheet. The sheet may comprise an amount of secondary resin of about 5%, about 10%, about 15%, about 20%, about 25%, about 30%, about 35%, about 40%, about 45%, about 48%, about 49%, about 50%, about 51%, about 52%, about 55%, about 60%, about 65%, about 70%, about 80%, or about 95% by weight of sheet. In some examples, the sheet comprises about 50% base resin and about 50% secondary resin. In some examples, the sheet comprises about 50% base resin and about 49% secondary resin. In some examples, the single-layer sheet comprises about 35% base resin and about 55% secondary resin. In some embodiments, the base resin is a polypropylene. In some embodiments, the secondary resin is a polypropylene. In some examples both the base resin and the secondary resin are a polypropylene. In some embodiments, the base resin is a polypropylene homopolymer. In some embodiments, the secondary resin is a polypropylene impact copolymer.

In some examples, the sheet comprises a polymeric mixture comprising a polypropylene homopolymer and a polypropylene impact copolymer. Illustratively, the sheet may comprise up to 99% polypropylene homopolymer. In some examples, the sheet may comprise up to 99% polypropylene impact copolymer. The sheet may comprise an amount of polypropylene homopolymer selected from a range of about 5% to about 95%, about 10% to about 95%, about 10% to about 85%, about 20% to about 85%, about 20% to about 75%, about 30% to about 75%, about 40% to about 75%, or about 40% to about 60% by weight of sheet. In some embodiments, the sheet may comprise an amount of polypropylene homopolymer selected from a range of about 15% to about 75%, about 15% to about 65%, about 15% to about 50%, about 20% to about 50%, or about 25% to about 45% by weight of sheet. The sheet may comprise an amount of polypropylene homopolymer of about 5%, about 10%, about 15%, about 20%, about 25%, about 30%, about 35%, about 40%, about 45%, about 48%, about 49%, about 50%, about 51%, about 52%, about 55%, about 60%, about 65%, about 70%, about 80%, or about 95% by weight of sheet. The sheet may comprise an amount of polypropylene impact copolymer selected from a range of about 5% to about 95%, about 10% to about 95%, about 10% to about 85%, about 20% to about 85%, about 20% to about 75%, about 25% to about 70%, about 30% to about 75%, about 40% to about 75%, about 45% to about 65%, or about 40% to about 60% by weight of sheet. The sheet may comprise an amount of polypropylene impact copolymer of about 5%, about 10%, about 15%, about 20%, about 25%, about 30%, about 35%, about 40%, about 45%, about 48%, about 49%, about 50%, about 51%, about 52%, about 55%, about 60%, about 65%, about 70%, about 80%, or about 95% by weight of sheet. In some examples, the sheet comprises about 50% polypropylene homopolymer and about 50% polypropylene impact copolymer. In some examples, the sheet comprises about 50% polypropylene homopolymer and about 49% polypropylene impact copolymer. In some examples, the single-layer sheet comprises about 35% polypropylene homopolymer and about 55% polypropylene impact copolymer.

In some embodiments, the sheet has a rubber content up to about 50% by weight of sheet. In some embodiments, the sheet comprises at least 0.05%, 1%, 2%, 3%, 4%, 5%, 6%, 7%, 8%, 9%, 10%, 12%, 14%, 16%, 18%, 20%, 25%, 30%, 35%, or 40% by weight rubber. In some embodiments, the rubber content of the sheet can be selected from a first series of ranges of about 0.5% to about 50%, about 0.5% to about 40%, about 0.5% to about 30%, about 0.5% to about 20%, about 0.5% to about 18%, about 0.5% to about 16%, about 0.5% to about 10%, or about 0.5% to about 5% by weight of the single-layer sheet. In some embodiments, the rubber content of the sheet can be selected from a second series of ranges of about 0.5% to about 20%, about 1% to about 20%, about 2% to about 20%, about 2.5% to about 20%, about 2.5% to about 20%, about 3% to about 20%, about 3.5% to about 20%, about 4% to about 20%, about 4.5% to about 20%, about 5% to about 20%, about 6% to about 20%, or about 7% to about 20% by weight of the sheet. In some embodiments, the rubber content of the sheet can be selected from a third series of ranges of about 0.5% to about 20%, about 1% to about 20%, about 1.5% to about 20%, about 2% to about 20%, about 2% to about 15%, about 2% to about 10%, about 2% to about 8%, or about 2% to about 5% by weight of the single-layer sheet. In some examples, the rubber content is about 0.5%, about 1%, about 1.5%, about 2%, about 2.5%, about 3%, about 3.5% about 4%, about 4.5% about 5%, about 6%, about 7%, about 7.5%, about 8%, about 8.5%, about 9%, about 9.5%, about 10%, about 12%, about 14%, about 16%, about 18%, about 20%, about 25%, about 30%, about 35%, about 40%, about 45%, or about 50% by weight of the sheet.

In some embodiments, the polypropylene homopolymer has a melt flow as measured by ASTM Method D1238 (230° C., 2.16 kg) of a range of about 1 g/10 min to about 10 g/10 min, about 1 g/10 min to about 5 g/10 min, or about 1 g/10 min to about 4 g/10 min. In some examples, the polypropylene homopolymer has a melt flow as measured by ASTM Method D1238 (230° C., 2.16 kg) of about 1 g/10 min, about 1.5 g/10 min, about 2 g/10 min, about 2.5 g/10 min, about 3 g/10 min, about 3.5 g/10 min, about 4 g/10 min, about 5 g/10 min, about 6 g/10 min, about 7 g/10 min, about 8 g/10 min, or about 10 g/10 min.

In some embodiments, the polypropylene homopolymer has a flexural modular as measured by ASTM Method D790A (0.05 in/min, 1% secant) of a range of about 100,000 psi to about 700,000 psi, about 100,000 psi to about 600,000 psi, about 100,000 psi to about 500,000 psi, or about 200,000 psi to about 500,000 psi. In some examples, the polypropylene homopolymer has a flexural modular as measured by ASTM Method D790A (0.05 in/min, 1% secant) of about 100,000 psi, about 200,000 psi, about 250,000 psi, about 300,000 psi, about 350,000 psi, about 400,000 psi, about 500,000 psi, about 600,000 psi, or about 700,000 psi.

In some embodiments, the polypropylene impact copolymer has a melt flow as measured by ASTM Method D1238 (230° C., 2.16 kg) of a range of about 1 g/10 min to about 10 g/10 min, about 1 g/10 min to about 8 g/10 min, about 2 g/10 min to about 8 g/10 min, or about 2 g/10 min to about 6 g/10 min. In some examples, the polypropylene impact copolymer has a melt flow as measured by ASTM Method D1238 (230° C., 2.16 kg) of about 1 g/10 min, about 2 g/10 min, about 2.5 g/10 min, about 3 g/10 min, about 3.5 g/10 min, about 4 g/10 min, about 4.5 g/10 min, about 5 g/10 min, about 5.5 g/10 min, about 6 g/10 min, about 7 g/10 min, about 8 g/10 min, or about 10 g/10 min.

In some embodiments, the polypropylene impact copolymer has a flexural modular as measured by ASTM Method D790A (0.05 in/min, 1% secant) of a range of about 100,000 psi to about 700,000 psi, about 100,000 psi to about 600,000 psi, about 100,000 psi to about 500,000 psi, or about 200,000 psi to about 500,000 psi. In some examples, the polypropylene impact copolymer has a flexural modular as measured by ASTM Method D790A (0.05 in/min, 1% secant) of about 100,000 psi, 200,000 psi, about 230,000 psi, about 250,000 psi, about 300,000 psi, about 350,000 psi, about 400,000 psi, about 500,000 psi, about 600,000 psi, or about 700,000 psi.

In some embodiments, the polypropylene impact copolymer has a rubber content up to about 50% by weight of the polypropylene impact copolymer. In some embodiments, the polypropylene impact copolymer comprises at least 0.05%, 1%, 2%, 3%, 4%, 5%, 6%, 7%, 8%, 9%, 10%, 12%, 14%, 16%, 18%, 20%, 25%, 30%, 35%, or 40% by weight rubber. In some embodiments, the rubber content of the polypropylene impact copolymer can be selected from a first series of ranges of about 0.5% to about 50%, about 0.5% to about 40%, about 0.5% to about 30%, about 0.5% to about 20%, about 0.5% to about 18%, about 0.5% to about 16%, or about 0.5% to about 10% by weight of the polypropylene impact copolymer. In some embodiments, the rubber content of the polypropylene impact copolymer can be selected from a second series of ranges of about 0.5% to about 30%, about 1% to about 30%, about 3% to about 30%, about 5% to about 30%, about 6% to about 30%, or about 7% to about 30% by weight of the polypropylene impact copolymer. In some embodiments, the rubber content of the polypropylene impact copolymer can be selected from a third series of ranges of about 0.5% to about 30%, about 1% to about 30%, about 1% to about 20%, about 2% to about 20%, about 2% to about 15%, about 3% to about 15%, about 3% to about 10%, or about 5% to about 10% by weight of the polypropylene impact copolymer. In some examples, the rubber content is about 0.5%, about 1%, about 3%, about 4%, about 5%, about 6%, about 7%, about 7.5%, about 8%, about 8.5%, about 9%, about 9.5%, about 10%, about 12%, about 14%, about 16%, about 18%, about 20%, about 25%, about 30%, about 35%, about 40%, about 45%, or about 50% by weight of the polypropylene impact copolymer.

In some embodiments, the sheet comprises a polymeric mixture further comprising an additive. Exemplary additives include a copolymer, clarifiers, process aids, slip agents, combinations thereof, or any suitable material for improving the single-layer sheet. In some embodiments, the additive is a clarifier. In some embodiments, the clarifier is a polypropylene random copolymer. In some embodiments, the additive is a copolymer. In some embodiments, the additive is a random copolymer. In some embodiments, the copolymer is an ethylene-polypropylene copolymer. In some embodiments, the copolymer is a random ethylene-polypropylene copolymer. In some embodiments, the sheet comprises Braskem RP650. In some embodiments, the additive is Braskem RP650.

In some embodiments, the additive may be up to about 20% or up to about 10% by weight of the polymeric mixture of the sheet. In some embodiments, the additive may be selected from a range of about 0.5% to about 20%, about 0.5% to about 15%, about 5% to about 15%, about 0.5% to about 10%, about 0.5% to about 5%, or about 0.5% to about 3% by weight of the sheet. In some embodiments the sheet comprises about 0.5%, about 1%, about 1.5%, about 2%, about 3%, about 4%, about 5%, about 6%, about 8%, about 10%, about 12%, about 14%, about 16%, about 18%, or about 20%, by weight of an additive. In some embodiments, the polymeric mixture of the sheet comprises about 0.5% to about 5% ethylene-propylene copolymer. In some embodiments, the polymeric mixture comprises about 0.5% to about 15% ethylene-propylene random copolymer. In some embodiments, the polymeric mixture comprises about 5% to about 15% ethylene-propylene random copolymer.

In some embodiments, the sheet consists of a polymeric mixture comprising a first polypropylene and a second polypropylene in accordance with the present disclosure. In some embodiments, the sheet comprises a polymeric formulation consisting of a first polypropylene, a second polypropylene, and an additive. In some embodiments, the sheet comprises a polymeric formulation consisting of a first polypropylene, a second polypropylene, and a random copolymer. In some embodiments, the sheet comprises a polymeric formulation consisting of a first polypropylene, a second polypropylene, and an ethylene-propylene copolymer. In some embodiments, the sheet comprises a polymeric formulation consisting of a first polypropylene and a second polypropylene.

In some embodiments, the sheet consists of a polymeric mixture comprising a base resin and a secondary resin in accordance with the present disclosure. In some embodiments, the sheet comprises a polymeric formulation consisting of a base resin, a secondary resin, and an additive. In some embodiments, the sheet comprises a polymeric formulation consisting of a base resin, a secondary resin, and a random copolymer. In some embodiments, the sheet comprises a polymeric formulation consisting of a base resin, a secondary resin, and an ethylene-propylene copolymer. In some embodiments, the sheet comprises a polymeric formulation consisting of a polypropylene homopolymer and an polypropylene impact copolymer. In some embodiments, the sheet comprises a polymeric formulation consisting of a polypropylene homopolymer, a polypropylene impact copolymer, and a polypropylene random copolymer.

In some embodiments, the sheet consists of a polymeric mixture consisting of a base resin and a secondary resin in accordance with the present disclosure. In some embodiments, the sheet consists of a polymeric formulation consisting of a base resin, a secondary resin, and an additive. In some embodiments, the sheet consists of a polymeric formulation consisting of a base resin, a secondary resin, and a random copolymer. In some embodiments, the sheet consists of a polymeric formulation consisting of a base resin, a secondary resin, and an ethylene-propylene copolymer. In some embodiments, the sheet consists of a polymeric formulation consisting of a polypropylene homopolymer and an polypropylene impact copolymer. In some embodiments, the sheet consists of a polymeric formulation consisting of a polypropylene homopolymer, a polypropylene impact copolymer, and a polypropylene random copolymer.

EXAMPLES

The following examples are set forth for purposes of illustration only. Parts and percentages appearing in such examples are by weight unless otherwise stipulated. All ASTM, ISO, and other standard test methods cited or referred to in this disclosure are incorporated by reference in their entirety.

Example 1

Formulation and Extrusion

An exemplary single-layer sheet in accordance with certain aspects of the present disclosure is provided in the instant example. The sheet in this example is a single-layer sheet.

A polymeric mixture comprised a polypropylene homopolymer, a polypropylene impact copolymer, and a polypropylene random copolymer. The polypropylene homopolymer was Braskem INSPIRE™ 6025N. The polypropylene impact copolymer was LyondellBassell Pro-Fax™ SC204. The clarifier was Braskem RP650. The percentages by weight of the components were about:

| | |
|---|---|
| 50% | Braskem INSPIRE ™ 6025N |
| 49% | LyondellBassell Pro-fax ™ SC204 |
| 1% | Braskem RP650 |

The polypropylene homopolymer, the polypropylene impact copolymer, and the polypropylene random copolymer were added to an extruder hopper and combined via blending to provide a formulation. The formulation was then heated in the extruder to form a molten material. The molten material was extruded to form a single-layer sheet. The single-layer sheet was thermoformed to form a lid in accordance with the present disclosure.

Example 2

Formulation and Extrusion

An exemplary single-layer sheet in accordance with certain aspects of the present disclosure is provided in the instant example. The sheet in this example is a single-layer sheet.

A polymeric mixture comprised a polypropylene homopolymer and a polypropylene impact copolymer. The polypropylene homopolymer was Braskem INSPIRE™ 6025N. The polypropylene impact copolymer was LyondellBassell Pro-Fax™ SC204. The percentages by weight of the components were about:

| | |
|---|---|
| 50% | Braskem INSPIRE ™ 6025N |
| 50% | LyondellBassell Pro-fax ™ SC204 |

The polypropylene homopolymer and the polypropylene impact copolymer were added to an extruder hopper and combined via blending to provide a formulation. The formulation was then heated in the extruder to form a molten material. The molten material was extruded to form a single-layer sheet. The single-layer sheet was thermoformed to form a lid in accordance with the present disclosure.

Example 3

Formulation and Extrusion

An exemplary single-layer sheet in accordance with certain aspects of the present disclosure is provided in the instant example. The sheet in this example is a single-layer sheet.

A polymeric mixture comprised a polypropylene homopolymer, a polypropylene impact copolymer, and a polypropylene random copolymer. The polypropylene homopolymer was Braskem INSPIRE™ 6025N. The polypropylene impact copolymer was LyondellBassell Pro-Fax™ SC204. The clarifier was Braskem RP650. The percentages by weight of the components were about:

| | |
|---|---|
| 35% | Braskem INSPIRE ™ 6025N |
| 55% | LyondellBassell Pro-fax ™ SC204 |
| 10% | Braskem RP650 |

The polypropylene homopolymer, the polypropylene impact copolymer, and the polypropylene random copolymer were added to an extruder hopper and combined via blending to provide a formulation. The formulation was then heated in the extruder to form a molten material. The molten material was extruded to form a single-layer sheet. The single-layer sheet was thermoformed to form a lid in accordance with the present disclosure.

The following numbered clauses include embodiments that are contemplated and non-limiting:

Clause 1. A lid for a cup, the lid comprising a ring-shaped brim mount having a round shape with a center point located on a central axis of the lid, the ring-shaped brim mount being adapted to couple to a brim included in a cup, a central closure coupled to the ring-shaped brim mount, and a deformable product-identification dome coupled to the central closure, wherein the lid comprises about 35% by weight a polypropylene base resin and about 55% by weight a polypropylene secondary resin.

Clause 2. A lid for a cup, the lid comprising a ring-shaped brim mount adapted to couple to a brim included in a cup, and a central closure coupled to the ring-shaped brim mount and adapted to close a top aperture opening into an interior liquid-storage region formed in the cup.

Clause 3. The lid of clause 2, any other clause, or any combination of clauses, wherein the brim mount has a round shape with a center point located on a central axis of the lid.

Clause 4. The lid of clause 3, any other clause, or any combination of clauses, further comprising a deformable product-identification dome coupled to the central closure.

Clause 5. The lid of clause 4, any other clause, or any combination of clauses, wherein the deformable product-identification dome is arranged to move from a first arrangement in which the deformable product-identification dome extends upwardly away from the central closure to a second arrangement in which the deformable product-identification dome is arranged to extend downwardly away from the central closure in response to a downward deformation force being applied to the deformable product-identification dome.

Clause 6. The lid of clause 5, any other clause, or any combination of clauses, wherein the deformable product-identification dome has a first transparency in the first arrangement.

Clause 7. The lid of clause 6, any other clause, or any combination of clauses, wherein the deformable product-identification dome has a second transparency in the second arrangement.

Clause 8. The lid of clause 7, any other clause, or any combination of clauses, wherein the second transparency is different than the first transparency.

Clause 9. The lid of clause 8, any other clause, or any combination of clauses, wherein the first transparency is defined at least by having a clarity between about 50% and about 95% as measured using ASTM D 1746.

Clause 10. The lid of clause 9, any other clause, or any combination of clauses, wherein the first transparency is defined at least by having a clarity greater than about 60% as measured using ASTM D 1746.

Clause 11. The lid of clause 10, any other clause, or any combination of clauses, wherein the first transparency is defined at least by having a haze between about 20% and about 40% as measured using ASTM D 1003 procedure B.

Clause 12. The lid of clause 11, any other clause, or any combination of clauses, wherein the first transparency is defined at least by having a haze less than about 40% as measured using ASTM D 1003 procedure B.

Clause 13. The lid of clause 8, any other clause, or any combination of clauses, wherein the first transparency is defined at least by having a haze between about 20% and about 40% as measured using ASTM D 1003 procedure B.

Clause 14. The lid of clause 8, any other clause, or any combination of clauses, wherein the deformable product-identification dome is arranged to move from the second arrangement to a third arrangement in which the deformable product-identification dome is arranged to extend upwardly away from the central closure in response to an upward deformation force and the deformable product-identification dome has a third transparency in the third arrangement.

Clause 15. The lid of clause 14, any other clause, or any combination of clauses, wherein the third transparency is different than the second transparency.

Clause 16. The lid of clause 15, any other clause, or any combination of clauses, wherein the third transparency is different than the first transparency.

Clause 17. The lid of clause 8, any other clause, or any combination of clauses, wherein the deformable product-identification dome includes a cap and a plurality of panels arranged around the cap and adjacent panels are coupled to one another to form stress concentrator joints.

Clause 18. The lid of clause 17, any other clause, or any combination of clauses, wherein the plurality of panels includes eight trapezoid shaped panels and the cap is octagon shaped.

Clause 19. The lid of clause 17, any other clause, or any combination of clauses, wherein the plurality of panels includes six panels and the cap is hexagon shaped.

Clause 20. The lid of clause 17, any other clause, or any combination of clauses, wherein the cap is formed to include at least one depression.

Clause 21. The lid of clause 8, any other clause, or any combination of clauses, wherein the deformable product-identification dome is hemispherical.

Clause 22. The lid of clause 17, any other clause, or any combination of clauses, wherein the cap includes an upper surface, a lower surface, and a side surface that extends between and interconnects the upper surface and the lower surface.

Clause 23. The lid of clause 22, any other clause, or any combination of clauses, wherein the side surface couples to the upper surface at a curved edge.

Clause 24. The lid of clause 23, any other clause, or any combination of clauses, wherein the lower surface couples to the plurality of panels at curved edges.

Clause 25. The lid of clause 8, any other clause, or any combination of clauses, wherein the central closure has a closure transparency that is about equal to the first transparency of the deformable product-identification dome.

Clause 26. The lid of clause 8, any other clause, or any combination of clauses, wherein the lid comprises a polypropylene homopolymer base resin.

Clause 27. The lid of clause 26, any other clause, or any combination of clauses, wherein the lid comprises a polypropylene impact copolymer secondary resin.

Clause 28. The lid of clause 27, any other clause, or any combination of clauses, wherein the lid comprises a polypropylene random co-polymer tertiary resin.

Clause 29. The lid of clause 28, any other clause, or any combination of clauses, wherein the lid comprises about 25% to about 55% by weight the base resin.

Clause 30. The lid of clause 29, any other clause, or any combination of clauses, wherein the lid comprises about 45% to about 60% by weight the secondary resin.

Clause 31. The lid of clause 30, any other clause, or any combination of clauses, wherein the lid comprises about 1% to about 15% by weight the tertiary resin.

Clause 32. The lid of clause 28, any other clause, or any combination of clauses, wherein the lid comprises about 35% by weight the base resin, about 55% by weight the secondary resin, and about 10% by weight the tertiary resin.

Clause 33. The lid of clause 32, any other clause, or any combination of clauses, wherein the deformable product-identification dome includes a cap and a plurality of panels arranged around the cap and adjacent panels are coupled to one another to form stress concentrator joints configured to induce the second transparency in the second arrangement.

Clause 34. The lid of clause 33, any other clause, or any combination of clauses, wherein the plurality of panels includes eight trapezoid shaped panels and the cap is octagon shaped, the cap includes an upper surface, a lower surface, and a side surface that extends between and interconnects the upper surface and the lower surface, the side surface couples to the upper surface at a curved edge, and the lower surface couples to the plurality of panels at curved edges.

Clause 35. The lid of clause 34, any other clause, or any combination of clauses, wherein the first transparency is defined at least by having a clarity greater than about 70% as measured using ASTM D 1746 and a haze less than about 30% as measured using ASTM D 1003 procedure B.

Clause 36. The lid of clause 8, any other clause, or any combination of clauses, wherein the lid is free from polystyrene.

Clause 37. The lid of clause 8, any other clause, or any combination of clauses, wherein the lid is free from aromatic materials.

Clause 38. The lid of clause 8, any other clause, or any combination of clauses, wherein the lid comprises about 25% to about 45% of a base resin and about 45% to about 65% of a secondary resin.

Clause 39. The lid of clause 38, any other clause, or any combination of clauses, wherein the base resin is a polypropylene homopolymer.

Clause 40. The lid of clause 39, any other clause, or any combination of clauses, wherein the secondary resin is a polypropylene impact copolymer.

Clause 41. The lid of clause 40, any other clause, or any combination of clauses, wherein the lid further comprises about 5% to about 15% by weight of a random copolymer.

Clause 42. The lid of clause 41, any other clause, or any combination of clauses, wherein the lid comprises about 0.5% to about 20% by weight of a rubber.

Clause 43. The lid of clause 38, any other clause, or any combination of clauses, wherein the lid comprises about 25% to about 70% by weight of the secondary resin.

Clause 44. The lid of clause 40, any other clause, or any combination of clauses, wherein the lid further comprises up to about 15% by weight of a random copolymer.

Clause 45. The lid of clause 44, any other clause, or any combination of clauses, wherein the lid comprises about 0.5% to about 20% by weight of a rubber.

Clause 46. The lid of clause 38, any other clause, or any combination of clauses, wherein the lid comprises up to about 99% by weight base resin.

Clause 47. The lid of clause 46, any other clause, or any combination of clauses, wherein the lid comprises about 15% to about 75% by weight base resin.

Clause 48. The lid of clause 47, any other clause, or any combination of clauses, wherein the lid comprises about 15% to about 65% by weight base resin.

Clause 49. The lid of clause 48, any other clause, or any combination of clauses, wherein the lid comprises about 25% to about 45% by weight base resin.

Clause 50. The lid of clause 49, any other clause, or any combination of clauses, wherein the base resin is a polypropylene.

Clause 51. The lid of clause 50, any other clause, or any combination of clauses, wherein the polypropylene is a polypropylene homopolymer.

Clause 52. The lid of clause 38, any other clause, or any combination of clauses, wherein the lid comprises up to about 99% by weight secondary resin.

Clause 53. The lid of clause 52, any other clause, or any combination of clauses, wherein the lid comprises about 20% to about 85% by weight secondary resin.

Clause 54. The lid of clause 53, any other clause, or any combination of clauses, wherein the lid comprises about 30% to about 75% by weight secondary resin.

Clause 55. The lid of clause 54, any other clause, or any combination of clauses, wherein the lid comprises about 45% to about 65% by weight secondary resin.

Clause 56. The lid of clause 55, any other clause, or any combination of clauses, wherein the secondary resin is a polypropylene.

Clause 57. The lid of clause 56, any other clause, or any combination of clauses, wherein the polypropylene is a polypropylene copolymer.

Clause 58. The lid of clause 57, any other clause, or any combination of clauses, wherein the polypropylene copolymer is a polypropylene impact copolymer.

Clause 59. The lid of clause 38, any other clause, or any combination of clauses, wherein the secondary resin is a polypropylene impact copolymer.

Clause 60. The lid of clause 59, any other clause, or any combination of clauses, wherein the polypropylene impact copolymer comprises up to 50% by weight rubber.

Clause 61. The lid of clause 60, any other clause, or any combination of clauses, wherein the polypropylene impact copolymer comprises about 0.5% to about 40% by weight rubber.

Clause 62. The lid of clause 61, any other clause, or any combination of clauses, wherein the polypropylene impact copolymer comprises about 0.5% to about 20% by weight rubber.

Clause 63. The lid of clause 38, any other clause, or any combination of clauses, wherein the lid comprises up to about 50% weight of a rubber.

Clause 64. The lid of clause 63, any other clause, or any combination of clauses, wherein the lid comprises about 0.5% to about 30% by weight of a rubber.

Clause 65. The lid of clause 64, any other clause, or any combination of clauses, wherein the lid comprises about 1% to about 20% rubber.

Clause 66. The lid of clause 65, any other clause, or any combination of clauses, wherein the lid comprises about 4% to about 20% rubber.

Clause 67. The lid of clause 38, any other clause, or any combination of clauses, wherein the lid further comprises up to about 20% by weight of an additive.

Clause 68. The lid of clause 67, any other clause, or any combination of clauses, wherein the additive is about 0.5% to about 20% by weight of the lid.

Clause 69. The lid of clause 68, any other clause, or any combination of clauses, wherein the additive is about 5% to about 15% by weight of the lid.

Clause 70. The lid of clause 68, any other clause, or any combination of clauses, wherein the additive is selected from the group consisting of a clarifier, a process aid, a slip agent, and a combination thereof.

Clause 71. The lid of clause 70, any other clause, or any combination of clauses, wherein the additive is a clarifier.

Clause 72. The lid of clause 71, any other clause, or any combination of clauses, wherein the clarifier is a copolymer.

Clause 73. The lid of clause 72, any other clause, or any combination of clauses, wherein the copolymer is a polypropylene copolymer.

Clause 74. The lid of clause 73, any other clause, or any combination of clauses, wherein the polypropylene copolymer is a polypropylene random copolymer.

Clause 75. A sheet made of polymeric materials, the sheet comprising a polypropylene homopolymer base resin, a polypropylene impact co-polymer secondary resin, and a polypropylene random co-polymer tertiary resin.

Clause 76. The sheet of clause 75, any other clause, or any combination of clauses, wherein the sheet comprises about 25% to about 55% by weight the base resin.

Clause 77. The sheet of clause 76, any other clause, or any combination of clauses, wherein the sheet comprises about 45% to about 60% by weight the secondary resin.

Clause 78. The sheet of clause 77, any other clause, or any combination of clauses, wherein the sheet comprises about 1% to about 15% by weight the tertiary resin.

Clause 79. The sheet of clause 75, any other clause, or any combination of clauses, wherein the sheet comprises about 35% by weight the base resin.

Clause 80. The sheet of clause 79, any other clause, or any combination of clauses, wherein the sheet comprises about 55% by weight the secondary resin.

Clause 81. The sheet of clause 80, any other clause, or any combination of clauses, wherein the sheet comprises about 10% by weight the tertiary resin.

The invention claimed is:

1. A lid for a cup, the lid comprising a ring-shaped brim mount having a round shape with a center point located on a central axis of the lid, the ring-shaped brim mount being adapted to couple to a brim included in a cup, a central closure coupled to the ring-shaped brim mount and adapted to close a top aperture opening into an interior liquid-storage region formed in the cup, and a deformable product-identification dome coupled to the central closure, the deformable product-identification dome arranged to move from a first arrangement in which the deformable product-identification dome extends upwardly away from the central closure to a second arrangement in which the deformable product-identification dome is arranged to extend downwardly away from the central closure in response to a downward deformation force being applied to the deformable product-identification dome, wherein the lid comprises polypropylene and the deformable product-identification dome has a first transparency in the first arrangement and a second transparency in the second arrangement and the second transparency is different than the first transparency, wherein the lid comprises at least 49% by weight polypropylene.

2. A lid for a cup, the lid comprising a ring-shaped brim mount having a round shape with a center point located on a central axis of the lid, the ring-shaped brim mount being adapted to couple to a brim included in a cup, a central closure coupled to the ring-shaped brim mount and adapted to close a top aperture opening into an interior liquid-storage region formed in the cup, and a deformable product-identification dome coupled to the central closure, the deformable product-identification dome arranged to move from a first arrangement in which the deformable product-identification dome extends upwardly away from the central closure to a second arrangement in which the deformable product-identification dome is arranged to extend downwardly away from the central closure in response to a downward deformation force being applied to the deformable product-identification dome, wherein the lid comprises polypropylene and the deformable product-identification dome has a first transparency in the first arrangement and a second transparency in the second arrangement and the second transparency is different than the first transparency, wherein the lid comprises at least 49% by weight a polypropylene impact copolymer.

3. The lid of claim 2, wherein the lid comprises at least 99% by weight the polypropylene impact copolymer.

4. The lid of claim 3, wherein the first transparency is defined at least by having a clarity greater than about 50% as measured using ASTM D 1746.

5. The lid of claim 4, wherein the first transparency is defined at least by having a haze less than about 40% as measured using ASTM D 1003 procedure B.

6. The lid of claim 1, wherein the lid comprises at least 99% by weight polypropylene.

7. The lid of claim 1, wherein the first transparency is defined at least by having a clarity greater than about 50% as measured using ASTM D 1746 and the first transparency is defined at least by having a haze less than about 40% as measured using ASTM D 1003 procedure B.

8. The lid of claim 1, wherein the lid is made of non-aromatic materials.

9. The lid of claim 1, wherein the polypropylene is a polypropylene impact copolymer.

10. The lid of claim 9, wherein the first transparency is defined at least by having a clarity greater than about 50% as measured using ASTM D 1746.

11. The lid of claim 10, wherein the first transparency is defined at least by having a haze in a range of about 10% to about 60% as measured using ASTM D 1003 procedure B.

12. The lid of claim 11, wherein the lid comprises at least 99% by weight the polypropylene impact copolymer.

13. A lid for a cup, the lid comprising a ring-shaped brim mount having a round shape with a center point located on a central axis of the lid, the ring-shaped brim mount being adapted to couple to a brim included in a cup, a central closure coupled to the ring-shaped brim mount and adapted to close a top aperture opening into an interior liquid-storage region formed in the cup, and a deformable product-identification dome coupled to the central closure, the deformable product-identification dome arranged to move from a first arrangement in which the deformable product-identification dome extends upwardly away from the central closure to a second arrangement in which the deformable product-identification dome is arranged to extend downwardly away from the central closure in response to a downward deformation force being applied to the deformable product-identification dome, wherein the deformable product-identification dome has a first transparency in the first arrangement, a second transparency in the second arrangement, the second transparency is different than the first transparency, and the first transparency is defined at least by having a clarity between about 50% and about 95% as measured using ASTM D 1746, wherein the deformable product-identification dome includes a cap and a plurality of panels arranged around the cap and adjacent panels are coupled to one another to form stress concentrator joints, wherein the cap includes an upper surface, a lower surface, and a side surface that extends between and interconnects the upper surface and the lower surface, the side surface couples to the upper surface at a curved edge, and the lower surface couples to the plurality of panels at curved edges.

14. The lid of claim 13, wherein the lid comprises polypropylene.

15. The lid of claim 14, wherein the lid comprises at least 49% by weight a polypropylene impact copolymer.

16. The lid of claim 15, wherein the lid comprises at least 99% by weight the polypropylene impact copolymer.

17. The lid of claim 15, wherein the first transparency is defined at least by having a haze less than about 40% as measured using ASTM D 1003 procedure B.

18. A lid for a cup, the lid comprising a ring-shaped brim mount having a round shape with a center point located on a central axis of the lid, the ring-shaped brim mount being adapted to couple to a brim included in a cup, a central closure coupled to the ring-shaped brim mount and adapted to close a top aperture opening into an interior liquid-storage region formed in the cup, and a deformable product-identification dome coupled to the central closure, the deformable product-identification dome arranged to move from a first arrangement in which the deformable product-identification dome extends upwardly away from the central closure to a second arrangement in which the deformable product-identification dome is arranged to extend downwardly away from the central closure in response to a downward deformation force being applied to the deformable product-identification dome, wherein the deformable product-identification dome has a first transparency in the first arrangement, a second transparency in the second arrangement, the second transparency is different than the first transparency, and the lid comprises a polypropylene impact copolymer, wherein the lid further comprises a polypropylene homopolymer, wherein the lid comprises at least about 45% by weight the polypropylene impact copolymer.

19. The lid of claim 18, wherein the lid further comprises a polypropylene random co-polymer.

20. The lid of claim 19, wherein the lid comprises about 1% to about 15% by weight the polypropylene random co-polymer.

* * * * *